US007292800B2

(12) United States Patent
Miyazawa et al.

(10) Patent No.: US 7,292,800 B2
(45) Date of Patent: Nov. 6, 2007

(54) IMAGE FORMING APPARATUS WITH SELECTIVELY ROTATED DEVELOPING ROLLER

(75) Inventors: Hiroshi Miyazawa, Nagano-ken (JP); Minoru Kishigami, Nagano-ken (JP); Kuniaki Tanaka, Nagano-ken (JP); Nobuyuki Mizushima, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 215 days.

(21) Appl. No.: 10/919,808

(22) Filed: Aug. 17, 2004

(65) Prior Publication Data

US 2006/0039720 A1 Feb. 23, 2006

(30) Foreign Application Priority Data

Aug. 19, 2003 (JP) ..... P2003-295009
Aug. 27, 2003 (JP) ..... P2003-302422

(51) Int. Cl.
*G03G 15/08* (2006.01)
*G03G 15/01* (2006.01)

(52) U.S. Cl. ..... 399/53; 399/227

(58) Field of Classification Search ..... 399/223, 399/226, 227, 228, 222, 53
See application file for complete search history.

(56) References Cited

U.S. PATENT DOCUMENTS 5,585,911 A * 12/1996 Hattori et al. ..... 399/227
6,122,469 A * 9/2000 Miura et al. ..... 399/227
6,285,154 B1 * 9/2001 Yasuda et al. ..... 318/696
6,813,459 B2 * 11/2004 Kishigami ..... 399/227
6,985,684 B2 * 1/2006 Matsuo et al. ..... 399/227
2003/0142996 A1 * 7/2003 Hiroki ..... 399/227

FOREIGN PATENT DOCUMENTS

| | | |
|---|---|---|
| JP | 09-114180 | 5/1997 |
| JP | 09-160374 | 6/1997 |
| JP | 2909319 | 4/1999 |
| JP | 11-133702 | 5/1999 |
| JP | 11-143296 | 5/1999 |
| JP | 2000-221861 | 8/2000 |
| JP | 3155761 | 2/2001 |
| JP | 2002-082532 | 3/2002 |
| JP | 2002-287461 | 10/2002 |
| JP | 2003-066801 | 3/2003 |

* cited by examiner

*Primary Examiner*—David M. Gray
*Assistant Examiner*—Ruth N. LaBombard
(74) *Attorney, Agent, or Firm*—Hogan & Hartson LLP

(57) ABSTRACT

An image forming apparatus includes an image carrier formed with a latent image A developing device has a developing roller driven by a stepping motor. A rotary development apparatus supports the developing device on a rotating shaft to rotate to a developing position opposed to the image carrier to form an image by developing the latent image formed at the image carrier and transfers the developed image to a medium at a transferring position The developing roller is driven by the stepping motor in a region of the latent image of the image carrier and is stopped in a holding state in a region in which the latent image is not formed by a current lower than a current in driving the developing roller.

20 Claims, 9 Drawing Sheets

IMAGE FORMING APPARATUS WITH SELECTIVELY ROTATED DEVELOPING ROLLER

The present application is based on Japanese Patent Applications Nos. 2003-295009 and 2003-302422, the entire contents of which are incorporated herein by reference.

BACKGROUND OF THE INVENTION

1. Field of the Invention

The present invention relates to an image forming apparatus to form an image by developing a latent image formed on an image carrier by a development apparatus and transferring the developed developer image at a transferred position.

More specifically the present invention relates to an image forming apparatus having the image carrier formed with the latent image, a developing device having a developing roller driven to rotate by a stepping motor and carrying a developer for developing the latent image, and a rotary development apparatus for supporting the developing device centering on a rotating shaft to move to rotate to a developing position opposed to the image carrier and constituted to form the image by developing the latent image formed at the image carrier at a developing position by the developing device and transferring the developed developer image to a medium at the transferring position.

2. Related Art

An image forming apparatus is arranged with a charging device for uniformly charging a photosensitive body along a rotational direction, an exposing device for forming an electrostatic latent image on the photosensitive body, a developing device for developing the electrostatic latent image by bringing a developing roller into contact with the photosensitive body, a transferring apparatus for transferring a toner image on the photosensitive body onto a transferring member, a cleaner for cleaning a surface of the photosensitive body after having been transferred therewith at an outer periphery of the photosensitive body which is an image carrier. Further, the toner image is formed by developing the electrostatic latent image formed on the photosensitive body by the exposing device by the developing device, the formed toner image is transferred onto the transferring member, and the toner remaining on the photosensitive body after having been transferred therewith is removed from above the photosensitive body by the cleaner to clean.

In the case of an image forming apparatus for forming a full color image, color toner images formed on the photosensitive body by the respective developing device of yellow Y, magenta M, cyan C, and black K are successively transferred onto an intermediate transferring medium to overlap colors. Therefore, there are a rotary type and a tandem type, in the types, the image forming apparatus of the rotary type is provided with a rotary development apparatus attachably and detachably mounted with a plurality of developing device (developing cartridges) radially centering on a rotating shaft of a rotary frame for developing the electrostatic latent image formed on the surface of the photosensitive body to the toner image by successively moving to rotate the developing device of respective colors of the rotary development apparatus to a developing position opposed to the surface of the photosensitive body by operating to switch the developing colors of the rotary development apparatus. In the color image forming apparatus having the rotary development apparatus, there is known a system of butting a rolling member arranged coaxially with the developing roller to the photosensitive body by urging the developing device in a direction of the photosensitive body to position relative to the photosensitive body for ensuring a proper gap between the photosensitive body and the developing roller (developer carrier) (refer to, for example, JP-A-2003-66801 and JP-A-2002-82532).

The rotary development apparatus is provided with the developing position, an interchanging position, and a standby position of the respective developing device for moving to rotate and stop, as a method of successively positioning to lock the respective developing device at the predetermined positions, it is the simplest to utilize a holding force of a drive motor for rotating the rotary, however, in consideration of power consumption, holding performance and the like of the drive motor in holding, it is preferable to position the rotary by some mechanical means without depending on the holding force of the drive motor. Hence, it has been proposed to mechanically position the rotary by engaging a lever provided at a main body of the image forming apparatus with a portion of the rotary (refer to, for example, JP-A-2002-287461). The lever is provided movably between an escaping position which does not position the rotary and a positioning position (constraining position) for positioning a rotary by engaging with the rotary and is engaged with a portion of a rotary frame at the positioning position.

According to the color image forming apparatus having the rotary development apparatus of the above-described background art, when the full color image is formed, development and transcription are similarly repeated while successively switching a plurality of developing device by operating to switch developing colors of the rotary development apparatus to overlap the plurality of toner images, however, when a single color image is formed, the toner image is formed repeatedly by making a predetermined one of the developing device opposed to the photosensitive body. That is, in the case of the full color image, rotation of the developing roller is stopped when the developing device are switched by operating to switch the developing colors of the rotary development apparatus, however, for example, when an image of only black color is continuously formed, it is not necessary to switch the developers and it is not also necessary to stop to rotate the developing roller. Therefore, even when development is not actually carried out, for example, the developing roller is opposed to an interval between the latent images of the photosensitive body, so-to-speak an interval between sheets, the developing roller continues rotating while carrying the toner and therefore, the toner is wastefully consumed to contaminate inside of the apparatus.

Further, a member for restricting a layer thickness of the toner is brought into contact with the developing roller, by rotating the developing roller, the layer thickness of the toner (developer) carried by the developing roller is restricted, and electric charge is applied to the toner by friction. Therefore, while the developing roller is rotating, the developing roller and the layer thickness restricting member and the toner, or the toners are slid to produce friction and are considerably worn.

Therefore, when the developing roller continues to rotate during a time period of from printing on a first sheet to finishing printing on a final sheet, particularly including a time period during which development is not carried out as in the case of printing continuously a plurality of sheets of images by a single color toner, there poses a problem that there is a concern that the toner and the layer thickness restricting member are uselessly worn, proper electric charge is not applied to the toner, and image quality of the formed image is deteriorated. Further, since almost all of printing only by the single color toner is carried out by a toner in black color and therefore, there poses a problem that wear of the single color toner and wear of the member of the developing device is more progressed than that of toners of other colors and amounts of wearing members constituting the developing device significantly differ from each other among the developing device.

Moreover, in such the image forming apparatus, the developing roller brought into contact with the photosensitive body rotating in steady state is provided with a rotating mode and a stopping mode and is operated to switch from the rotating mode to the stopping mode and from the stopping mode to the rotating mode in a state of rotating the photosensitive body in steady state. As a method of driving the developing roller in this case, there is proposed a method in which at a vicinity at which a ratio of peripheral speeds of the developing roller to the photosensitive body is 1, an acceleration thereof is made to be larger than that of other speed region (refer to, for example, Japanese Patent Publication No. 2909319). This is for resolving a drawback that at the vicinity at which the ratio of the peripheral speeds is 1, the developer is uselessly adhered to the photosensitive body. Further, as other method, a stepping motor is decelerated to stop by a smooth deceleration profile (refer to, for example, JP-A-11-143296). This is for resolving a problem that a contact portion of a cleaning blade is turned up by reversely rotating the photosensitive body by being brought into a reversely rotating region relative to a rotational direction before being stopped by influence of inertia or the like in stopping the stepping motor.

However, according to the method of increasing the acceleration more than that of the other region at the vicinity at which the ratio of the peripheral speeds of the developing roller to the photosensitive body is 1, in the midst of acceleration or in the midst of deceleration, a load of the photosensitive body is rapidly varied, further, the load is also large since the ratio of the peripheral speeds is near to 1. Therefore, there poses a problem that a variation in the speed of the processing member rotating in steady state is increased and so-to-speak non-uniformity in rotation is brought about.

Similarly, according to the method of stopping the developing roller by the smooth deceleration profile, a change in the load of the photosensitive body at the vicinity at which the ratio of the peripheral speeds of the developing roller to the photosensitive body is 1 is increased. That is, when the ratio of the peripheral speeds becomes proximate to 1 from a state in which the peripheral speeds of the developing roller and the photosensitive body differ from each other to bring about considerable slippage, the slippage is reduced and the load of the photosensitive body is rapidly increased. Therefore, there poses the problem that the variation in the speed of the photosensitive body is increased and so-to-speak non-uniformity in rotation is brought about.

Even in the case in which the latent image formed on the photosensitive body is not being developed, when the latent image is being formed on the photosensitive body or when the toner image formed on the photosensitive body is being transferred, the non-uniformity in rotation of the photosensitive body constitutes a non-uniformity in the latent image or a non-uniformity in the transferred toner image and as a result, there poses a problem that image quality is deteriorated by bringing about a non-uniformity in the image.

SUMMARY OF THE INVENTION

The invention resolves the above-described problems and reduces useless consumption of toner, contamination in the image forming apparatus and wear and deterioration of the toner and a layer thickness restricting member or the like in continuously forming an image.

The invention also reduces a variation in rotation and a non-uniformity in rotation of the photosensitive body by restraining a rapid variation of a load of the photosensitive body accompanied by acceleration and deceleration of a developing roller.

For that object, the invention is characterized in an image forming apparatus including an image carrier formed with a latent image, a developing device having a developing roller driven to rotate by a stepping motor and carrying a developer for developing the latent image, and a rotary development apparatus for supporting the developing device centering on a rotating shaft thereof to rotate to move to a developing position opposed to the image carrier and constituted to form an image by developing the latent image formed at the image carrier by the developing device at the developing position and transferring the developed developer image onto a medium at a transferring position, wherein the developing roller disposed at the developing position is driven to rotate by the stepping motor in a region of the latent image of the image carrier and stopped to rotate in a region in which the latent image is not formed of the image carrier to hold to the same phase by a current lower than a current in driving to rotate the developing roller to constitute a holding state.

The invention is characterized in that a slowdown control is carried out when the stepping motor is stopped to rotate, the slowdown control is started after a front end of the region in which the latent image is not formed reaches the above-described developing position, after the front end of the region in which the latent image is not formed reaches the above-described transferring position, and after a rear end of the latent image region reaches the developing position and a deceleration of the developing roller is reduced at a vicinity of a rotational speed the same as a rotational speed of the image carrier when the developing roller is stopped to rotate.

The invention is characterized in that a slow up control is carried out when the developing roller is driven to rotate by the stepping motor from a rear end of the region in which the latent image is not formed and the slow up control is started before the rear end of the region in which the latent image is not formed reaches the developing position.

The invention is characterized in that the region in which the latent image is not formed is disposed between the continuous latent images when a plurality of the latent images is continuously formed at the image carrier by a specific one of the developing device and the developing device disposed at the developing position is butted to the image carrier by a rolling member arranged coaxially with the developing roller.

According to the invention, in the image forming apparatus including the image carrier formed with the latent image, the developing device having the developing roller driven to rotate by the stepping motor and carrying the developer for developing the latent image, and the rotary development apparatus for supporting the developing device centering apparatus centering on the rotating shaft to rotate to move to the developing position opposed to the image carrier and constituted to form the image by developing the latent image formed at the image carrier by the developing device at the developing position and transferring the developed developer image onto the medium at the transferred position, the developing roller disposed at the developed position is driven to rotate by the stepping motor in the region of the latent image of the image carrier and stopped to rotate at the region in which the latent image is not formed of the image carrier to hold to the same phase by the current lower than the current in driving to rotate the developing roller to constitute the holding state, in other words, the stepping motor is set in the hold mode. Therefore, it can be prevented that the developer is consumed by carrying the useless developer by the developing roller in the region in which the latent image is not formed and development is not carried out and the developer is scattered to contaminate inside of the apparatus. Further, by lowering a holding current in stopping the apparatus (the stepping motor is in the hold mode), wasteful consumption of power and heat generation can be restrained.

When the stepping motor is stopped to rotate, the slowdown control is carried out and after the front end of the region in which the latent image is not formed reaches the developing position, after the front end of the region in which the latent image is not formed reaches the transferring position, or after the rear end of the latent image region reaches the developing position, the slowdown control is started and when the developing roller is stopped to rotate, the deceleration of the developing roller is reduced at a vicinity of the rotational speed the same as that of the image carrier and therefore, in stopping the developing roller, even when the image is being transferred, a non-uniformity in rotating the image carrier can be restrained from being brought about and a shift in transferring the developer image can be prevented from being brought about and deterioration of the image by bringing about a non-uniformity or a streak of the image can be prevented.

When the developing roller is driven to rotate by the stepping motor from the rear end of the region in which the latent image is not formed, the slow up control is carried out and the slow up control is started before the rear end of the region in which the latent image is not formed reaches the developing position and therefore, even when the latent image is formed, the non-uniformity in rotating the image carrier can be restrained from being brought about. The non-uniformity in the latent image or the like can be prevented from being brought about and the deterioration of the image by bringing about the non-uniformity or the streak of the image can be prevented.

The region in which latent image is not formed is disposed between the continuous latent images when a plurality of the latent images are continuously formed to develop at the image carrier by a specific one of the developing devices, the developing device disposed at the developing position is butted to the image carrier by the rolling member arranged coaxially with the developing roller and therefore, in forming a single color image, even when the developing roller is stopped while fixing the developing device at the developing position, a large change in a load of the image carrier accompanied by stopping the developing roller can be absorbed, the non-uniformity in rotating the image carrier can be restrained from being brought about, the non-uniformity in the latent image, the shift in transcription or the like can be prevented from being brought about and the deterioration of the image by bringing about the non-uniformity or the steak of the image can be prevented.

According to the invention, even when the latent image region is continuously developed by using the specific developing device, in the region in which the latent image is not formed and the latent image is not developed, by stopping to rotate the developing roller, useless wear or deterioration of the developer and the members brought into contact with the developing roller can be prevented. Further, in either case of the case of rotating to move a plurality of the developing device to successively develop and in the case of developing the image by the specific developing device continuously without moving the developing device, when the latent image is not developed, the developing roller is stopped to rotate and therefore, useless wear or deterioration of the developer and the member brought into contact with the developing roller can be prevented from being progressed only at the specific developing device. Further, the developing roller is stopped to rotate after the front end of the region in which the latent image is not formed reaches the developing position and therefore, development in the latent image region is ensured and the rear end of the image is prevented from being deficient and darkness can be prevented from being reduced and even when the developing roller is stopped at the small region between the latent image of an amount of one medium and the latent image of an amount of the medium to be developed successively, useless wear and deterioration of the developer, the layer thickness restricting member and the like can considerably be reduced.

The invention is also characterized in an image forming apparatus including an image carrier formed with a latent image, and a development apparatus having a developing roller driven to rotate by a stepping motor and carrying a developer for developing the latent image and constituted to form an image by developing the latent image formed on the image carrier by the development apparatus and transcribing the developed developer image at a transcribing position, wherein the developing roller develops the latent image by being butted to the image carrier by a roller rotatably arranged coaxially therewith and rotated at a predetermined rotational speed larger than a rotational speed of the image carrier and driven to rotate by the stepping motor such that when the developing roller is decelerated from the predetermined rotational speed to stop and accelerated to the predetermined speed, an acceleration thereof in at least either of cases of decelerating or accelerating the developing roller is made to be smaller in a region of the rotational speed of the image carrier than accelerations before and after the region of the rotational speed.

The invention is characterized in that the developing roller is started to decelerate to stop after a rear end of the latent image formed at the image carrier reaches a developing position and is started to accelerate before a front end of the latent image formed at the image carrier reaches the developing position to constitute the predetermined rotational speed from a state of stopping the developing roller and that the acceleration of the developing roller is substantially nullified at the region of the rotational speed of the image carrier.

The invention is characterized in that the development apparatus comprises a developing rotary unit mounted with a developing cartridge at a rotary frame and rotated to move to carry out an operation of switching development, the developing rotor unit is mounted with a plurality of the developing cartridges having different toner colors, the developing roller is driven to rotate by the stepping motor to decelerate to stop prior to starting the operation of switching development carried out when a color image is formed and accelerate after finishing the operation of switching development to constitute the predetermined rotational speed, and the developing rotary unit is rotated to move in a rotational direction reverse to a direction of rotating the image carrier and the developing roller is butted to the image carrier by the roller at a position on a downstream side in the direction of the rotating image carrier from a line connecting a rotational axis of the developing rotary unit and the rotational axis of the image carrier.

The invention is characterized in that the developing roller is held in a state of being stopped at a region in which the image is not formed between the images formed when a plurality of sheets of the images are continuously formed, and the stepping motor maintains the state of being stopped by being held at the same phase by a current lower than a current in being driven to rotate.

According to the invention, in the image forming apparatus including the image carrier formed with the latent image, and the development apparatus having the developing roller driven to rotate by the stepping motor and carrying the developer for developing the latent image and constituted to form the image by developing the latent image formed on the image carrier by the development apparatus and transcribing the developed developer image onto the medium at the transcribing position, wherein the developing roller develops the latent image by being butted to the image carrier by the roller rotatably arranged coaxially therewith and rotated at the predetermined rotational speed larger than the rotational speed of the image carrier and when the developing roller is decelerated from the predetermined rotational speed to stop and accelerated to the predetermined rotational speed, the developing roller is driven to rotate by the stepping motor such that the acceleration at least either of the cases of being decelerated or accelerated is made to be smaller in the region of the rotational speed of the image carrier than the accelerations before and after the region of the rotational speed and therefore, the variation in the speed and the non-uniformity in rotation of the photosensitive body can be eliminated by restraining the rapid variation of the load applied to the image carrier in decelerating or accelerating and the deterioration of the image by bringing about the non-uniformity or the streak of the image can be prevented.

The developing roller is driven to rotate by the stepping motor to start to accelerate to stop after the rear end of the latent image formed on the image carrier reaches the developing position and starts to accelerate to constitute the predetermined rotational speed before the front end of the latent image formed at the image carrier reaches the developing position from the stopped state and therefore, the developing roller maintains the predetermined rotational speed in development and the front end and the rear end of the image can be prevented from being deficient or the darkness is prevented from being changed and by substantially nullifying the acceleration temporarily at the region of the rotational speed of the image carrier, the variation of the load of the image carrier can be made to be smooth.

The development apparatus comprises the developing rotary unit mounted with the developing cartridge at the rotary frame for carrying out the operation of switching development, the developing rotor unit is mounted with the plurality of developing cartridges having different toner colors, the developing roller is driven to rotate by the stepping motor to decelerate to stop prior to starting the operation of switching development carried out when the color image is formed and accelerate to constitute the predetermined rotational speed after finishing the operation of switching development and therefore, even in forming the latent image by starting to form the latent image on the image carrier, or in transcribing the image before finishing to transcribe the image from the image carrier to the intermediate transcribing medium, the non-uniformity in rotation of the image carrier can be prevented from being brought about by operating to decelerate or accelerate the developing roller, the non-uniformity in the latent image and the non-uniformity in transcribing the developer image accompanied by the non-uniformity in rotating the image carrier can be prevented from being brought about, the developing rotary unit is rotated to move in the rotational direction reverse to the direction of rotating the image carrier, the developing roller is butted to the roller at the position on the downstream side in the direction of rotating the image carrier from the line connecting the rotating axis of the developing rotary unit and the rotating axis of the image carrier, thereby, the developing roller is moved from the photosensitive body to separate to the downstream side in the rotational direction by the operation of switching development, and can be shifted swiftly to the operation of switching development and the image forming time period can be shortened.

The developing roller maintained the state of being stopped at the region in which the image is not formed between the images formed when a plurality of sheets of images are continuously formed, the stepping motor is held in the state of being stopped by being held at the same phase by the current lower than the current in driving to rotate the stepping motor and therefore, the developer can be prevented from being consumed and the developer can be prevented from being scattered at inside the apparatus to contaminate by carrying the useless developer by the developing roller in the region in which the image is not formed and development is not carried out. Further, by lowering the holding current in being stopped, wasteful consumption of power and heat generation can be restrained.

Further, according to the invention, even when the latent image region is continuously developed by using the specific developing device, in the region in which the latent image is not formed and the latent image is not developed, rotation of the developing roller can be stopped without bringing about non-uniformity in rotation of the image carrier and useless wear or deterioration of the developer and the member brought into contact with the developing roller can be prevented from being brought about. Further, in either case of successively developing the image by rotating to move the plurality of developing device and a case of developing the image by the specific developing device continuously without moving the developing device, when the latent image is not developed, rotation of the developing roller is stopped and therefore, useless wear or deterioration of the developer and the member brought into contact with the developing roller can be prevented from being progressed only in the specific developing device. Further, by stopping to rotate the developing roller after the front end of the region in which the latent image is not formed reaches the development position, development in the latent image region can be ensured, the rear end of the image can be prevented from being deficient and the darkness can be prevented from being lowered, and by stopping the developing roller even in the small region between the latent image of an amount of a medium and the latent image of an amount of the medium to be developed successively, useless wear or deterioration of the developer and the layer thickness restricting member and the like can considerably be reduced.

DETAILED DESCRIPTION OF THE PREFERRED EMBODIMENTS

Figure 1:
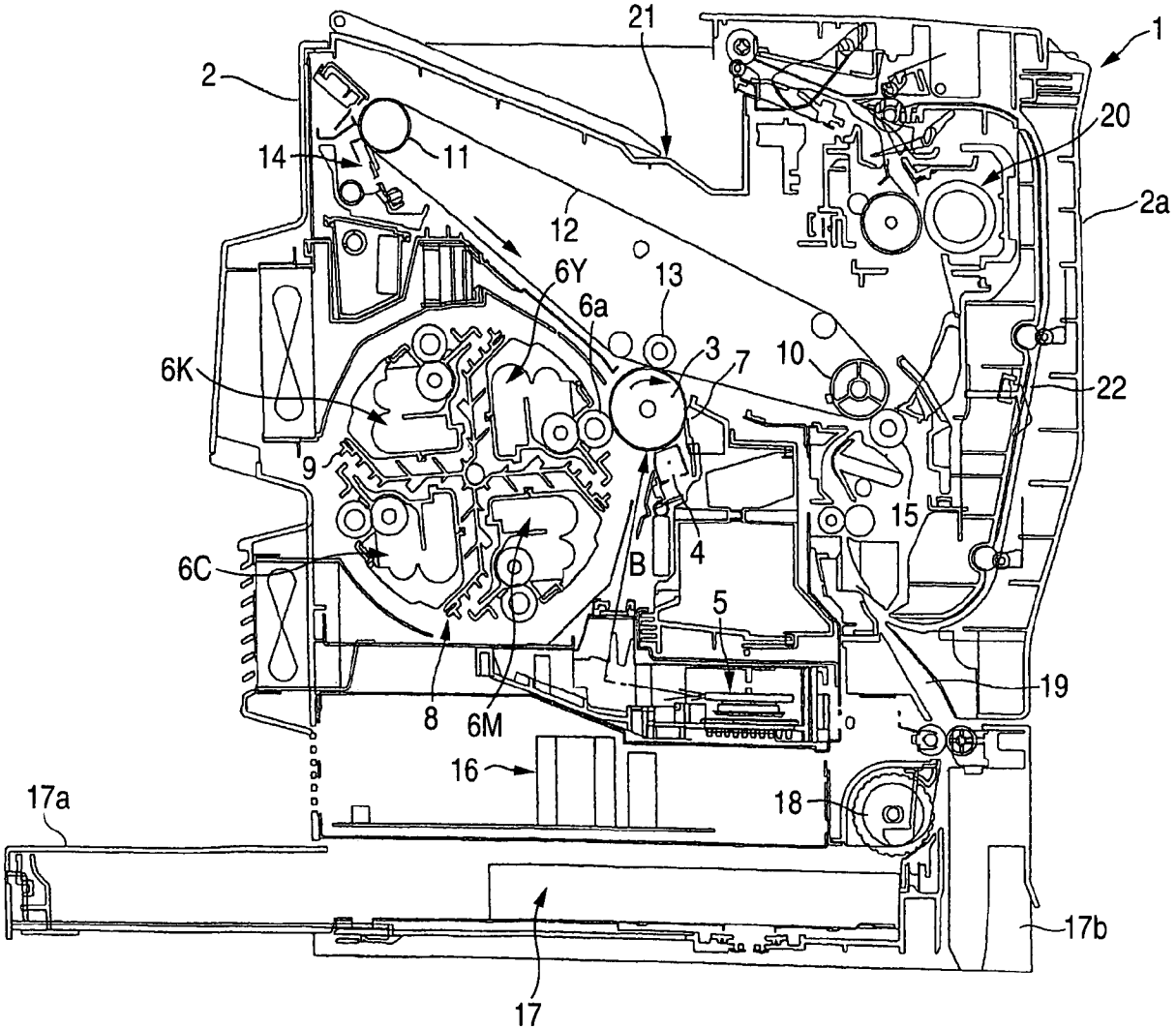
FIG. 1 is a view showing an embodiment of an image forming apparatus according to the invention.

An explanation will be given of an embodiment of the invention in reference to the drawings as follows. FIG. 1 is a view showing an embodiment of an image forming apparatus, in the drawing, numeral 1 designates an image forming apparatus, numeral 2 designates a main body case, numeral 3 designates a photosensitive body, numeral 4 designates a charging device, numeral 5 designates an exposing device, numeral 6 designates a developing device, numeral 7 designates a photosensitive body cleaner, numeral 8 designates a rotary development apparatus, numeral 9 designates a rotary frame, numeral 12 designates an intermediate transferring belt, numeral 13 designates a primary transferring roller, numeral 14 designates a transferring belt cleaner, numeral 15 designates a secondary transferring roller, numeral 16 designates a power source apparatus, numeral 17 designates a charge tray, numeral 20 designates a fixing unit, numeral 21 designates a discharge tray, and numeral 22 designates a sheet carrying unit.

As shown by FIG. 1, the image forming apparatus 1 of the embodiment includes the discharge tray 21 formed at an upper portion of the main body case 2, and a front cover 2*a* openably and closably inserted into a front face thereof. Inside of the main body case 2 is arranged with the rotary development apparatus 8 mounted with a plurality of the developing device, the photosensitive body 3 formed with a toner image by forming and developing an electrostatic latent image, and an intermediate transferring unit transferred with the toner image on the photosensitive body 3, the power source apparatus 16, the charge tray 17 containing a recording medium, the fixing unit 20 for fixing the toner image on the recording medium, a display unit comprising a liquid crystal panel constituting means for informing to a user, a control unit for governing operation of the image forming apparatus by controlling respective drive motors and biases and the units and the like. Further, inside of the front cover 2*a* is arranged with the sheet carrying unit 22 for carrying the recording medium from the charge tray 17 to the fixing unit 20 via the secondary transferring roller 15. Further, the respective units are constituted to be attachable and detachable to and from the main body and constituted to be able to integrally remove to repair or interchange in maintenance or the like.

The photosensitive body 3 which is the image carrier includes a conductive base member in a shape of a thin-walled cylinder, and a photosensitive layer formed at a surface thereof. An outer periphery of the photosensitive body 3 is arranged with the charging device 4 for uniformly charging the photosensitive body 3 along a rotational direction, the exposing device (or writing apparatus) 5 for forming the electrostatic latent image on the photosensitive body 3, the rotary development apparatus 8 for developing the electrostatic image, the intermediate transferring belt 12 transferred with the toner image on the photosensitive body 3, the intermediate transferring unit for primarily transferring the toner image onto the intermediate transferring belt 12, and the photosensitive body cleaner 7 for cleaning the surface of the photosensitive body 3 after having been transferred primarily therewith.

The intermediate transferring unit is constituted by a drive roller 10 and a driven roller 11, the inter mediate transferring belt 12 comprising a belt in an endless shape, made to wrap on the two rollers 10, 11 and driven in an illustrated arrow mark direction and transferred with the toner image on the photosensitive body 3, the primary transferring roller 13 arranged to be opposed to the photosensitive body 3 on a rear face of the intermediate transferring belt 12 for primarily transferring the toner image on the photosensitive body 3 onto the intermediate transferring belt 12, the transferring belt cleaner 14 for removing the toner remaining on the intermediate transferring belt 12, and the secondary transferring roller 15 arranged to be opposed to the drive roller 10 for secondarily transferring the toner image of full colors of 4 colors formed on the intermediate transferring belt 12 onto the recording medium (sheet or the like).

The power source apparatus 16 is arranged on a lower side of the exposing device 5, further, the charging cassette 17 is arranged at a bottom portion of the main body case 2, and the recording medium at inside of the charging cassette 17 is constituted to be carried to the discharge tray 21 via a pickup roller 18, a sheet member carrying path 19, the secondary transferring roller 15, and the fixing apparatus 20. Further, the charging cassette 17 is mounted to be able to extract to a front side of the apparatus by a handle 17*b* and is mounted with an auxiliary cassette 17*a* to be able to extract to project to a rear side of the apparatus to be able to deal with a case in which a sheet size is large.

Figure 2:
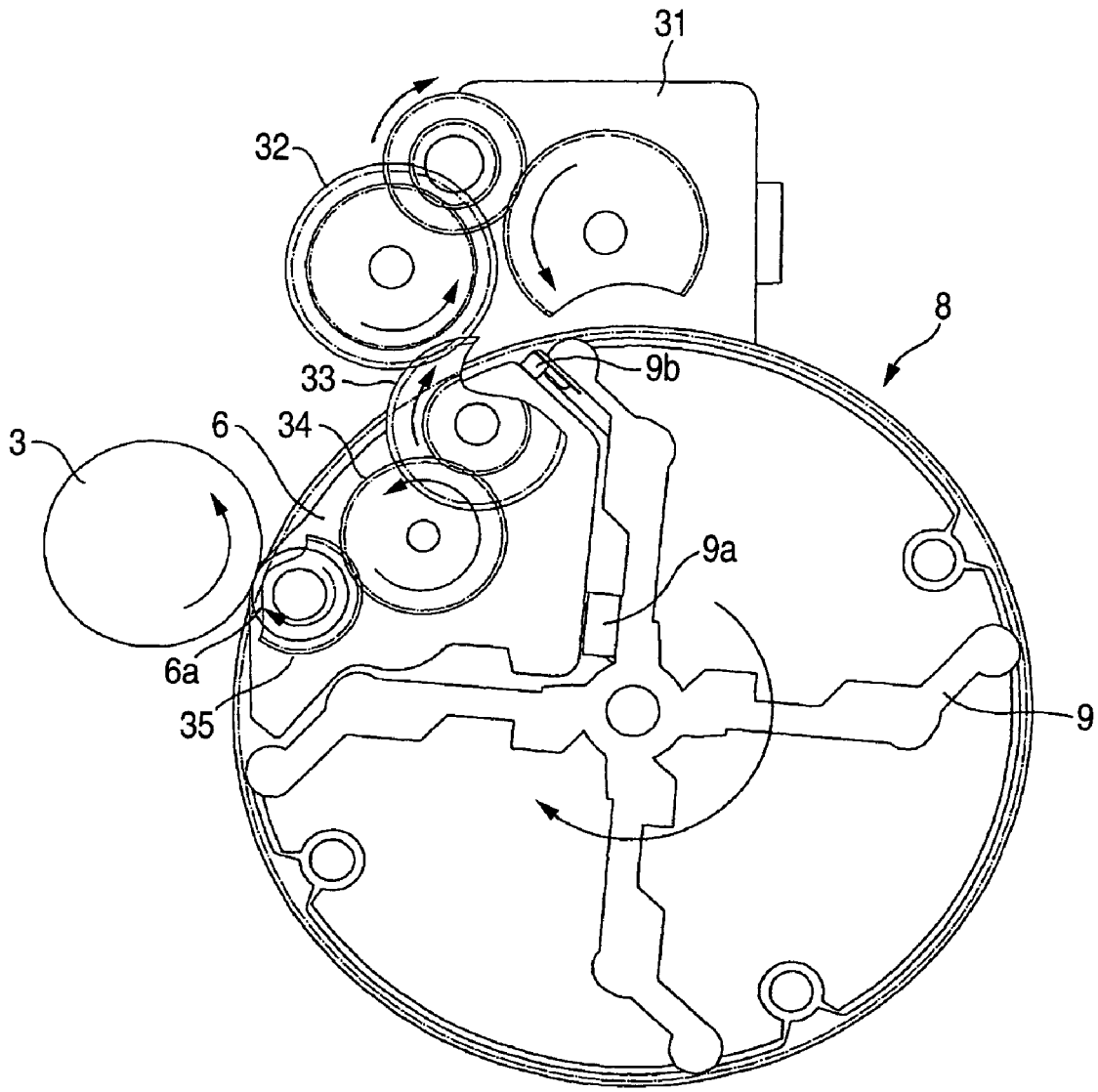
FIG. 2 is a view showing a drive wheel train of a developing device and a mechanism of pivoting to urge the developing device.
Figure 3:
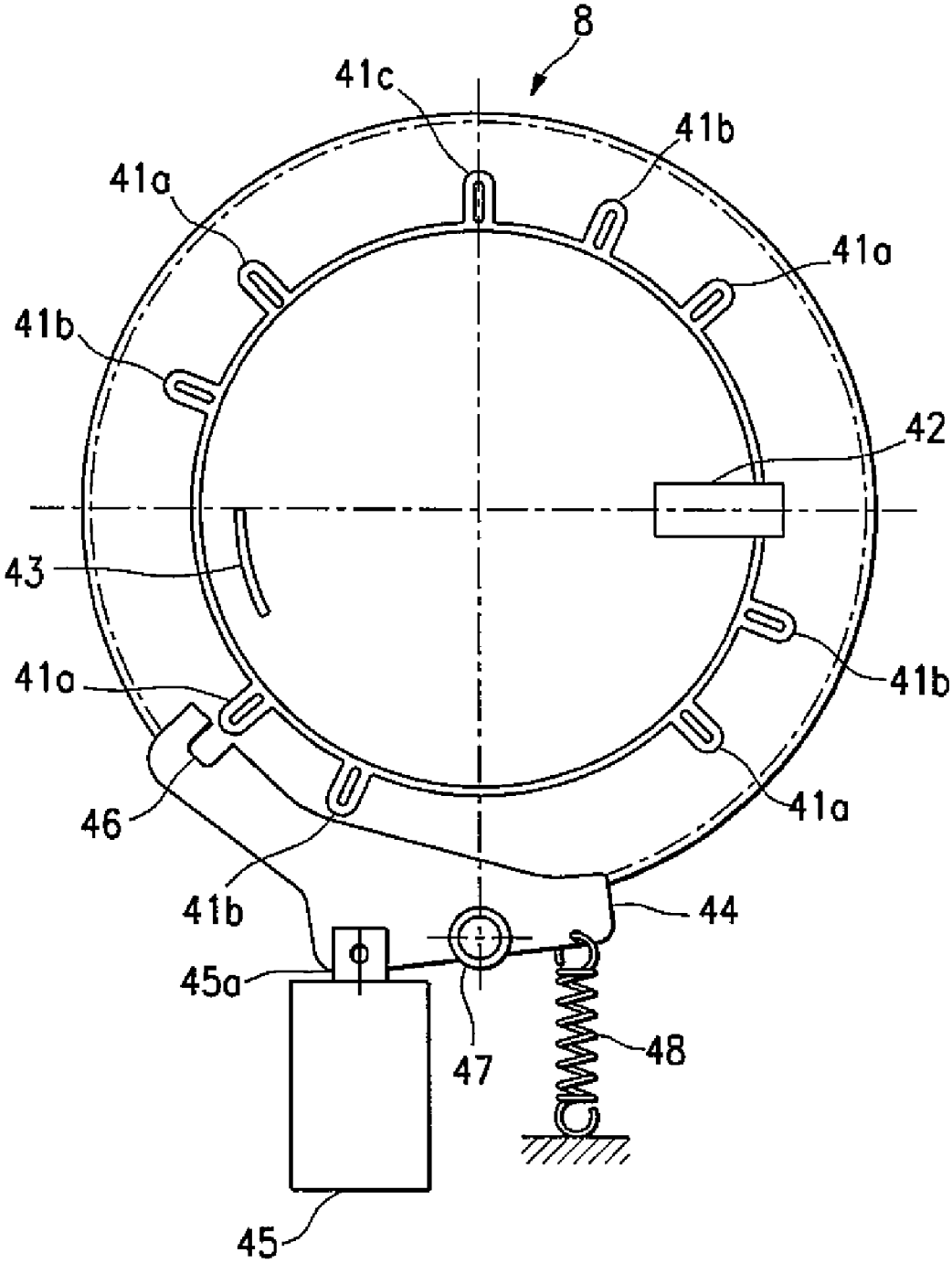
FIG. 3 is a view showing an example of a mechanism of positioning a rotary development apparatus.

FIG. 2 is a view showing a drive wheel train of the developing device and a mechanism of urging to pivot the developing device, and FIG. 3 is a view showing an example of a mechanism for positioning the rotary development apparatus. Notation 9*a* designates a developing device urging spring, Notation 9*b* designates a fitting rattle stopping elastic portion, numeral 31 designates a drive motor, numeral 32 designates a drive output gear, numeral 33 designates a rotary idler gear, numeral 34 designates a developing device input gear, numeral 35 designates a developing roller gear, numeral 41 designates a projected portion, numeral 42 designates a rotary phase detecting sensor, numeral 43 designates a sensor light blocking rib, numeral 44 designates a lock lever, numeral 45 designates a solenoid, numeral 46 designates a recess portion, and numeral 47 designates a fulcrum of a lock lever urging spring 48.

As shown by FIG. 2, engagement and disengagement of the wheel train in attaching and detaching the developing device 6 are carried out between the rotary idler gear 33 and the developing device input gear 34 arranged to the rotary frame 9, and the developing device 6 is highly accurately positioned pivotably to the rotary development apparatus 8 by a rotational center axis of the rotary idler gear 33 by a positioning mechanism using a pin for positioning the developing device provided at a front end of a rotating shaft of the rotary idler gear 33. By the positioning mechanism, engagement and disengagement are smoothly carried out by reducing play or rattle. Further, the rotary idler gear 33 is brought in mesh with the drive output gear 32 and is driven by the drive motor 31. When the rotary development apparatus 8 is rotated such that the developing device 6 in correspondence with a color of a developing process comes to the developing position, the drive output gear 32 is brought in mesh with the rotary idler gear 33 arranged at the rotary frame 9 of the rotary development apparatus 8.

By driving the drive output gear 32 in the counterclockwise direction and driving the rotary idler gear 33 in the clockwise direction, in the developing device 6, the wheel train comprising the developing device input gear 34 and the developing roller gear 35 is brought in mesh with the rotary idler gear 33. In the constitution of the wheel train, a drive force generated by bringing the rotary idler gear 33 and the developing device input gear 34 in mesh with each other is directed to an outer side in a radius direction of the rotary development apparatus 8, that is, a rotational direction directed in a direction of a center of the photosensitive body 3.

Therefore, a drive reaction force thereof is operated in a direction of pressing a developing roller 6*a* of the developing device 6 to the photosensitive body 3, further, the developing device 6 is urged to pivot by pressing the developing roller 6*a* to the photosensitive body 3 from a rear face of the developing device 6 by the developing device urging spring 9*a* fixed to the rotary frame 9. In contrast to urging to pivot the developing device 6, the fitting rattle stopping elastic member 9*b* is arranged as a shifting member for shifting in a direction orthogonal to a line constituted by connecting the rotating shaft of the rotary development apparatus 8 and a rotating shaft of the photosensitive body 3 at a vicinity of a positioning portion of fitting the positioning pin and a positioning hole of the developing device 6. Particularly, when a direction of a force of shifting by the fitting rattle stopping elastic member 9*b* is directed to a center of a pivoting fulcrum, a component of the force is not operated to pivoting the developing device 6 and therefore, a stable pre-pressure between the developing roller 6*a* and the photosensitive body 3 can be maintained.

The positioning mechanism as shown by FIG. 3 is provided to position the respective developing device 6 at a standby position, the developing position and an attaching and detaching position in the rotary development apparatus 8. The positioning mechanism is provided with locking means for stopping the rotary development apparatus 8 at a predetermined position and holding the rotary development apparatus 8 at a stop position thereof at other end side of the rotary development apparatus 8.

The locking means is constituted by a pair of projected portions (engaged portion) 41*a*, 41*b*, fixed respectively in correspondence with a mounting portion of each of the developing device 6 of the rotary frame 9 and one projected portion 41*c*, the lock lever (engaging portion) 44 having the recess portion 46 selectively engageable to the projected portions 41*a*, 41*b*, 41*c* at one end portion thereof and pivotable centering on the fulcrum 47, the lock lever urging spring (urging means) 48 connected to an end portion on a side opposed to the recess portion 46 of the lock lever 44 for always urging the recess portion 46 in a direction of engaging with one of the projected portions 41*a*, 41*b*, and the solenoid (moving means) 45 connected with a plunger 45*a* between the recess portion 46 of the lock lever 44 and the fulcrum 47 for operating a solenoid force to the lock lever 44 opposedly to a spring force of the lock lever urging spring 48 in a direction of separating the recess portion 46 from one of the projected portions 41*a*, 41*b* in operating to release lock by the plunger 45*a*.

Further, in FIG. 3, the rotary phase detecting sensor 42 is for detecting passing of the sensor light blocking rib 43 attached to the rotary frame 9 for detecting the developing position, the attaching and detaching position and the standby position of each of the developing device 6 by a rotational angle after the sensor light blocking rib 43 passes the rotary phase detected sensor 42. In FIG. 1 showing one end side of the rotary development apparatus 8, a rotational direction is constituted by the counterclockwise direction and therefore, at other end side thereof shown in FIG. 3, the rotational direction is constituted by the clockwise direction. Therefore, for example, when the rotary development apparatus 8 is brought into the standby state at a home position, the rotary development apparatus 8 is moved to rotate in the clockwise direction, the light blocking rib 43 passes the rotary phase detecting sensor 42 and thereafter, the rotary development apparatus 8 is further moved to rotate by 45 deg to engage the projected portion 41*c* with the recess portion 46, thereby, the rotary development apparatus 8 is positioned to the standby position to be brought into the standby state.

Further, at the detecting position, the toner color of each of the developing device 6 can be identified by the detecting apparatus, and the standby position can be determined from information of identifying the toner color at the detecting position. In accordance therewith, the rotary development apparatus 8 may be controlled to drive to move to rotate to the home position from the information of identifying the toner color at the detecting position without controlling to drive the rotary development apparatus 8 by the rotary phase detecting sensor 42 and the light blocking rib 43.

Figure 4:
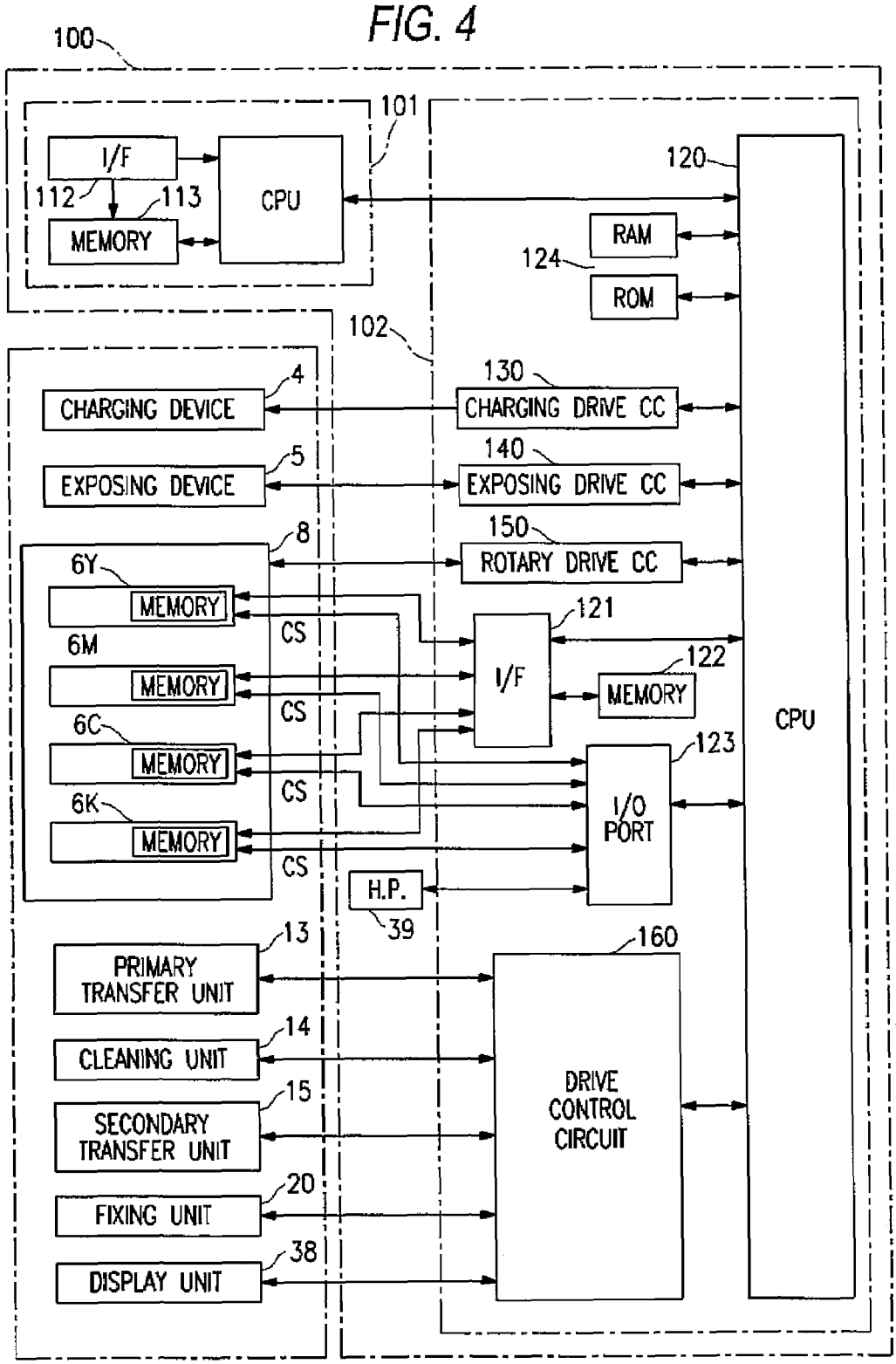
FIG. 4 is a diagram showing an example of a constitution of a total control system including a control unit.

FIG. 4 is a view showing a constitution example of a total control system including a control unit, a control unit 100 is constituted by a main controller 101 and a unit controller 102, the main controller 101 is inputted with an image signal, and the unit controller 102 controls the above-described respective units and the like to form an image in accordance with instruction based on the image signal.

The main controller 101 is connected to a host apparatus via an interface 112 and is provided with an image memory 113 for storing the image signal inputted from the host apparatus. The unit controller 102 is provided with CPU 120, a serial interface (I/F) 121, an input/output port 123, drive control circuit units of the respective units (a charging drive control circuit 130, and a exposing drive control circuit 140, a rotary drive control circuit 150 and respective drive control circuits 160 of the primary transferring unit, the cleaning unit, the secondary transferring unit, the fixing unit, the display unit), connected to the respective units of the apparatus main body (charging device 4, the exposing device 5, the rotary development apparatus 8, the primary transferring unit, the cleaning unit 14, the secondary transferring unit 15, the fixing unit 20, the display unit 38) and controls to drive the respective units based on a signal inputted from the main controller 101 by detecting states of the respective units by receiving signals from sensors provided to the respective units.

CPU 120 provided to the unit controller 102 is connected to a nonvolatile storing element (hereafter, referred to as main body side memory) 122 of serial EEPROM or the like used for an electronic counter via the serial interface (I/F) 121. The main body side memory 122 is stored with developing device information of the developing device 6 to be mounted to the rotary development apparatus 8 and data necessary for controlling the apparatus. Further, CPU 120 is connected with not only the main body side memory 122 but also developing device side memories provided at the respective developing device 6Y, 6M, 6C, 6K via the serial interface 121, data can be transmitted between the main body side memory 122 and the developing device side memories, and a chip select signal CS can be inputted to the respective developing device side memories via the input/output port 123. Therefore, after a predetermined one of the developing device 6 is moved to a position of attaching and detaching a connector and the connector of the developing device 6 and a common connector on the main body side are connected, data can be read from a memory designated by the chip select signal CS. Further, CPU 120 is also connected with an HP detecting portion 39 for detecting the home position via the input/output port 123.

The main body side memory 122 of the unit controller 102 is set with four storing regions for storing the state of the developing device 6 to be mounted to the rotary development apparatus 8 by data of 1 bit of "1" or "0". Here, "1" is abnormal data indicating an event in which access cannot be made to a corresponding one of the developing device side memories, or the developing device information read from the storing element differs from the developing device information stored to the main body side memory 122 of the unit controller 102, and "0" is normal data indicating an event that the corresponding developing device 6 is mounted.

The storing regions are provided for the respective developing device and made to correspond to mounting position information in the rotary development apparatus 8 and color information of contained toner. Here, for example, the first storing region is stored with data indicating a situation of mounting a yellow developing device 6Y, the second storing region is stored with data showing a situation of mounting the developing device 6M of magenta M, the third storing region is stored with data indicating a situation of mounting the developing device 6C of cyan C, and the fourth storing region is stored with information of the developing device 6K of black K, respectively, and when all of the proper developing device 6 are mounted, all of the respective storing regions are stored with "0". When, for example, a user switches on the power source while the developing device 6 is detached, or the user erroneously mounts a developing device 6 of a toner color which is not to be mounted in interchanging the developing device 6, and the events are detected, data of the storing regions are rewritten to "1" indicating the events before moving to the position of interchanging the developing devices. The data "1" is rewritten to "0" again when the proper developing device 6 is mounted to a holding portion constituting an object and thereafter, the power source is switched on by a signal indicating that the processing operation has been finished, for example, by closing an exterior cover, thereby, access is tried to make to the storing element of the mounted developing device 6 and when the developing device information is read and when the developing device information coincides with the developing device information of the holding portion constituting the object.

Further, the developing device side memory is also stored with toner remaining amount data and data indicating a number of times of recycle as recycling information. For example, at each time of printing, an amount of consuming the toner is counted in accordance with a printing size, a number of sheets and the like and stored as the toner remaining amount data and when a toner remaining amount is indicated as 0 by the toner remaining amount data, the data indicating the number of times of recycle is counted up.

Figure 5A:
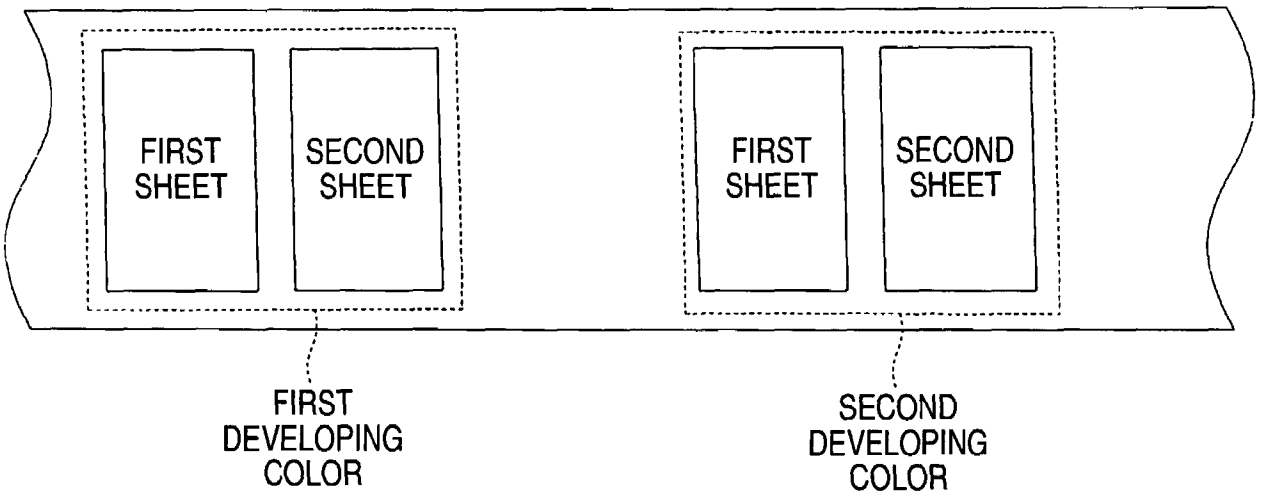
FIGS. 5A and 5B illustrate views for explaining a sheet size and a range of forming a latent image and a region in which the latent image is not formed by an image developed on an intermediate transferring belt.
Figure 5B:
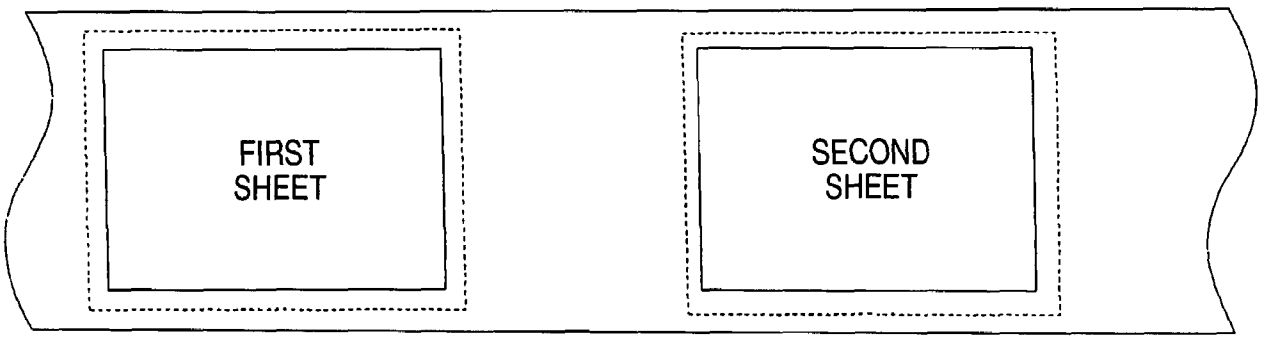
Figure 6A:
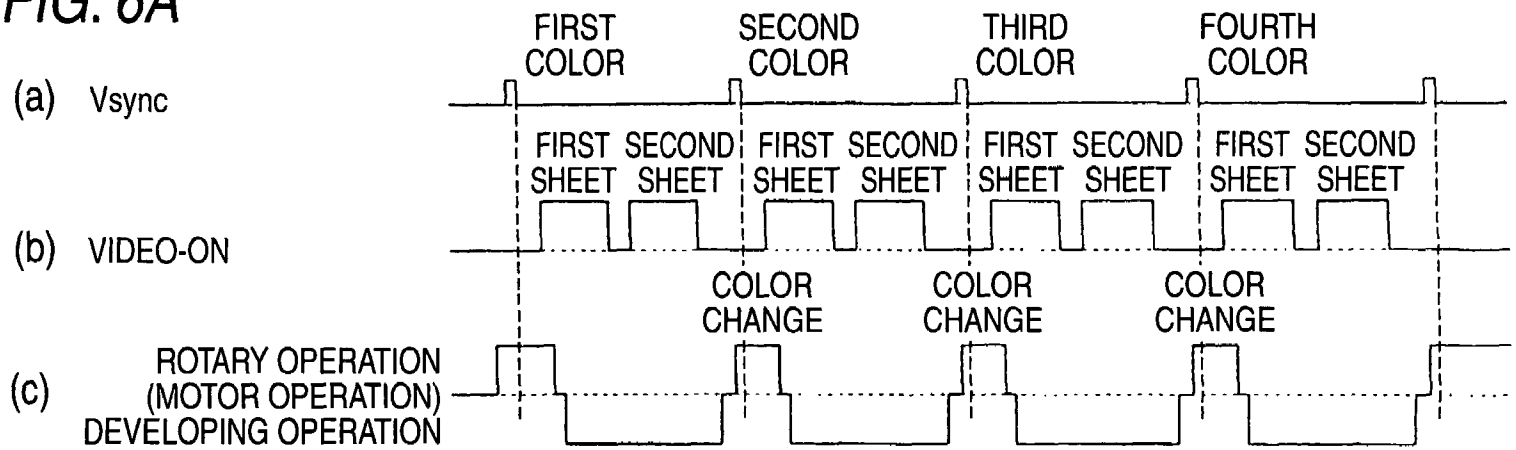
FIGS. 6A and 6B illustrate diagrams for explaining operation of switching a developing color and developing operation of a rotary development apparatus by an image forming mode.
Figure 6B:
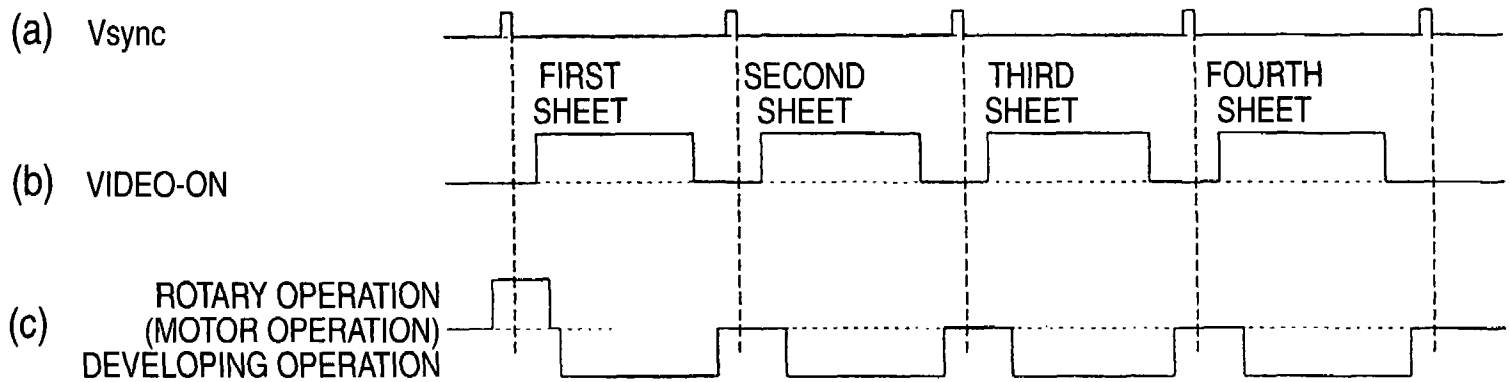

FIGS. 5A and 5B illustrate views for explaining a sheet size and a range of forming the latent image and a region in which the latent image is not formed by an image developed on the intermediate transferring belt, FIGS. 6A and 6B illustrate views for explaining operation of switching a developing color and developing operation of the rotary development apparatus in an image forming mode, and FIGS. 7A-7E illustrate views for explaining a relationship between a development driving and a non-uniformity in rotation of the photosensitive body.

According to the image forming apparatus 1 having the above-described constitution, when the image signal from the host computer is inputted to the main controller 101 via the interface (I/F) 112, in accordance with control of drive motors and biases by the unit controller 102, the photosensitive body 3, the developing roller 6*a* of the rotary development apparatus 8, and the intermediate transferring belt 12 are driven to rotate, first, an outer peripheral face of the photosensitive body 3 is charged uniformly by the charging device 4. The charged region of the photosensitive body 3 reaches the exposing position in accordance with rotation of the photosensitive body 3 and the latent image is formed at the latent image forming range of the first sheet of the region in accordance with image information in correspondence with the recording medium of the first sheet. During the time period, in the rotary development apparatus 8, the developing roller 6*a* of the developing device 6 is rotated to move to be brought into contact with the photosensitive body 3. Thereby, the toner image of the electrostatic latent image is formed on the photosensitive body 3. The toner image formed on the photosensitive body 3 is transferred onto the intermediate transferring belt 12 by the primary transferring roller 13 applied with a primary transferring voltage having a polarity reverse to a polarity of charging the toner and the toner remaining on the photosensitive body 3 is removed by the photosensitive body cleaner 7.

In operation of forming an image of full color, when an image of A4 size is formed by a plurality of sheets to the intermediate transferring belt 12 in correspondence with, for example, a maximum of A3 size, as shown by FIG. 5A, two sheets of images (first sheet, second sheet) are continuously transferred onto an image region (dotted line frame) on the intermediate transferring belt 12. Therefore, when Vsync (the vertical synchronizing signal) is detected as shown by FIG. 6A, first, the surface of the photosensitive body 3 is selectively exposed (video on) by the exposing device 5 in accordance with image information of a first color, for example, yellow Y, and the electrostatic latent image of yellow Y is repeatedly formed twice. On the other hand, the rotary development apparatus 8 starts developing operation by being rotated to move such that the developing roller 6*a* of the developing device 6Y of yellow Y is brought into contact with the photosensitive body 3 by operation of switching the developing color, and the toner image of the electrostatic latent image of yellow Y is formed on the photosensitive body 3. Successively, the toner image is transferred onto the intermediate transferring belt 12 by the primary transferring roller 13 applied with the primary transferring voltage having the polarity reverse to the polarity of charging the toner. During the time period, the transferring belt cleaner 14 and the secondary transferring roller 15 are separated from the intermediate transferring belt 12.

The full color of 4 colors image is formed by overlappingly transferring toner images of yellow Y, magenta M, cyan C, black K in accordance with contents of respective image forming signals from the photosensitive body 3 successively onto the intermediate transferring belt 12 by repeatedly executing a series of developing color switching operation, latent image forming operation and developing processing in correspondence with the second color, the third color, and the fourth color of the image forming signals.

Further, at a timing at which the image superposed with the respective color toner images reaches the secondary transferring roller 15, the recording medium of the charge tray 17 is carried from the pickup roller 18 to the secondary roller transferring roller 15 via a resistance roller and the sheet member carrying path 19, the secondary transferring roller 15 is pressed to the intermediate transferring belt 12 and a secondary transferring voltage is applied and the toner image on the intermediate transferring belt 12 is transferred onto the recording medium by the secondary transferring roller 15. When the recording medium transferred with the toner image in this way is carried to the fixing unit 20 by the sheet carrying unit 22, the toner image on the recording medium is heated and pressed to fix. The toner remaining on the intermediate transferring belt 12 is removed by the transferring belt cleaner 14.

Further, in the case of both face printing, the recording medium coming out from the fixing unit 20 is switched back such that a rear end thereof constitutes a front end thereof, supplied again to the secondary transferring roller 15 via a both face printing carrying path of the sheet carrying unit 22, and the full color toner image on the intermediate transferring belt 12 is transferred onto the recording medium and is heated and pressed to fix again by the fixing unit 20 and is discharged to the discharge tray 21.

Next, an explanation will be given of operation when a single color image is continuously formed on a plurality of record media by using a toner of black K. Here, when a sheet is constituted by the maximum size, as shown by FIG. 5B, the image is transferred fully in an image region on the intermediate transferring belt 12. When the continuous image of a single color by the toner of black K is set to form, as shown by FIG. 6B, the drive motor is operated and in the rotary development apparatus 8, the developing roller 6*a* of the developing device 6K containing the toner of black K is rotated to move to the developing position opposed to the photosensitive body 3 by operating to switch the developing color.

When the latent image in correspondence with the recording medium of the first sheet is formed on the photosensitive body 3 and moved in accordance with rotation of the photosensitive body 3, and a front end of the latent image region (rear end of a region in which the latent image is not formed) becomes proximate to the developing position opposed to the developing roller 6*a*, by operating the drive motor 31 to increase speed thereof to rotational speed of developing operation before reaching the developing position, the latent image is developed by the toner of black K by the developing device 6K. Thereby, the toner image of black K is formed on the photosensitive body 3. Here, the region in which the latent image is not formed is a region between the latent image forming regions (dotted line frames in FIGS. 5A and 5B) of an amount of one recording medium and the latent image forming range of an amount of the recording medium to be developed successively.

During a time period of developing the latent image, rotation of the drive motor 31 is transmitted via the drive output gear 32, the rotary idler gear 33, and the developing device input gear 34 to rotate the developing roller 6*a*, and a path of transmitting power to the rotary development apparatus 8 is cut by, for example, opening an electromagnetic clutch. The toner image of black K formed on the photosensitive body 3 is primarily transferred onto the intermediate transferring belt 12 by the primary transferring unit 13 and secondarily transferred onto the recording medium by the secondary transferring unit 15 similar to the color image, and heated and pressed by the fixing unit 20 to melt on the recording medium of sheet or the like.

After the latent image in correspondence with the recording medium of the first sheet has been finished to develop, and the rear end of the latent image region (front end of the region in which the latent image is not formed) in the direction of rotating the photosensitive body 3 reaches the developing position opposed to the developing roller 6*a*, or after elapse of a predetermined time period thereof, the drive motor 31 stops until a successive rotating operation as shown by FIG. 6B. During the time period, the rotary development apparatus 8 and the developing roller 6*a* are not rotated.

Successively, when the latent image in correspondence with the recording medium of the second sheet is formed on the photosensitive body 3 and the front end of the latent image region (rear end of the region in which the latent image is not formed) becomes proximate to the developing position opposed to the developing roller 6*a*, by operating the drive motor 31 to increase the speed to the rotational speed of the developing operation before reaching the developing position, the latent image of the second sheet is started to develop with the toner of black K by the developing device 6K. Further, when the rear end of the latent image region (front end of the region in which the latent image is not formed) of the second sheet reaches the developing position opposed to the developing roller 6*a*, or after elapse of a predetermined time period thereof, the drive motor 31 is stopped.

When the single color image is continuously formed to the plurality of record media in this way, before the front end of the latent image region (rear end of the region in which the latent image is not formed) reaches the developing position, and after the rear end of the latent image region (front end of the region in which the latent image is not formed) reaches the developing position, operation of rotating and operation of stopping the developing roller 6*a* are repeated on an outer side of the latent image region, that is, in the region in which the latent image is not formed. Thereby, the deficiency of the image or the reduction in darkness can be prevented from being brought about at the front end or the rear end of the image in accordance with operation of rotating and operation of stopping the developing roller 6*a*.

During a time period of continuously forming the image on the plurality of sheets, the photosensitive body 3 and the intermediate transferring belt 12 are continuously rotated, meanwhile, the rotary development apparatus 8, and the developing roller 6*a* or the like repeat to rotate and stop. Further, in the developing operation, the rotational speed $V_{DR}$ of the developing roller 6*a* is set to a rotational speed faster than that ($v_P$) of the photosensitive body 3 in order to carry out development by supplying sufficient toner from the developing roller 6*a* to the latent image on the photosensitive body 3. Further, the exposing position by the exposing device 5, the developing position opposed to the developing roller 6*a*, and the primary transferring position of the intermediate transferring belt 12 on the photosensitive body 3 are respectively separated successively to a downstream side relative to the direction of rotating the photosensitive body 3. Therefore, there is established a relationship in which when the rear end of the region in which the latent image is not formed of the photosensitive body 3 reaches the developing position of the developing roller 6*a*, exposure has already been started and at a time point at which the front end of the region in which the latent image is not formed of the photosensitive body 3 passes the developing position of the developing roller 6*a*, the toner image has not yet finished to transfer onto the intermediate transferring belt 12 at the primarily transferring position.

When attention is paid to a particular position on the photosensitive body 3, the particular position passes the exposing position, the developing position and the primarily transferring position successively in accordance with rotation and the developing position is disposed at a middle thereof. Therefore, when separation and contact of the developing roller 6*a* in accordance with operation of rotating and stopping and switching the developing color are going to be controlled in order to make a time period of rotating the developing roller 6*a* necessary minimum, the timings are constituted by the photosensitive body 3 being exposed or being transferred for forming the image. Making the time period of rotating the developing roller 6*a* necessary minimum achieves various advantages of reducing wasteful consumption of the toner, reducing contamination in the apparatus by scattering the toner, preventing useless wear of the toner or the layer thickness restricting member, preventing image quality of the formed image from being deteriorated since proper electric charge is not applied to the toner, prolonging life of the development apparatus, and shortening a time period of switching the developing color and so on and it is desired to restrain non-uniformity in rotation of the photosensitive body 3 in any of operational modes.

Figure 8:
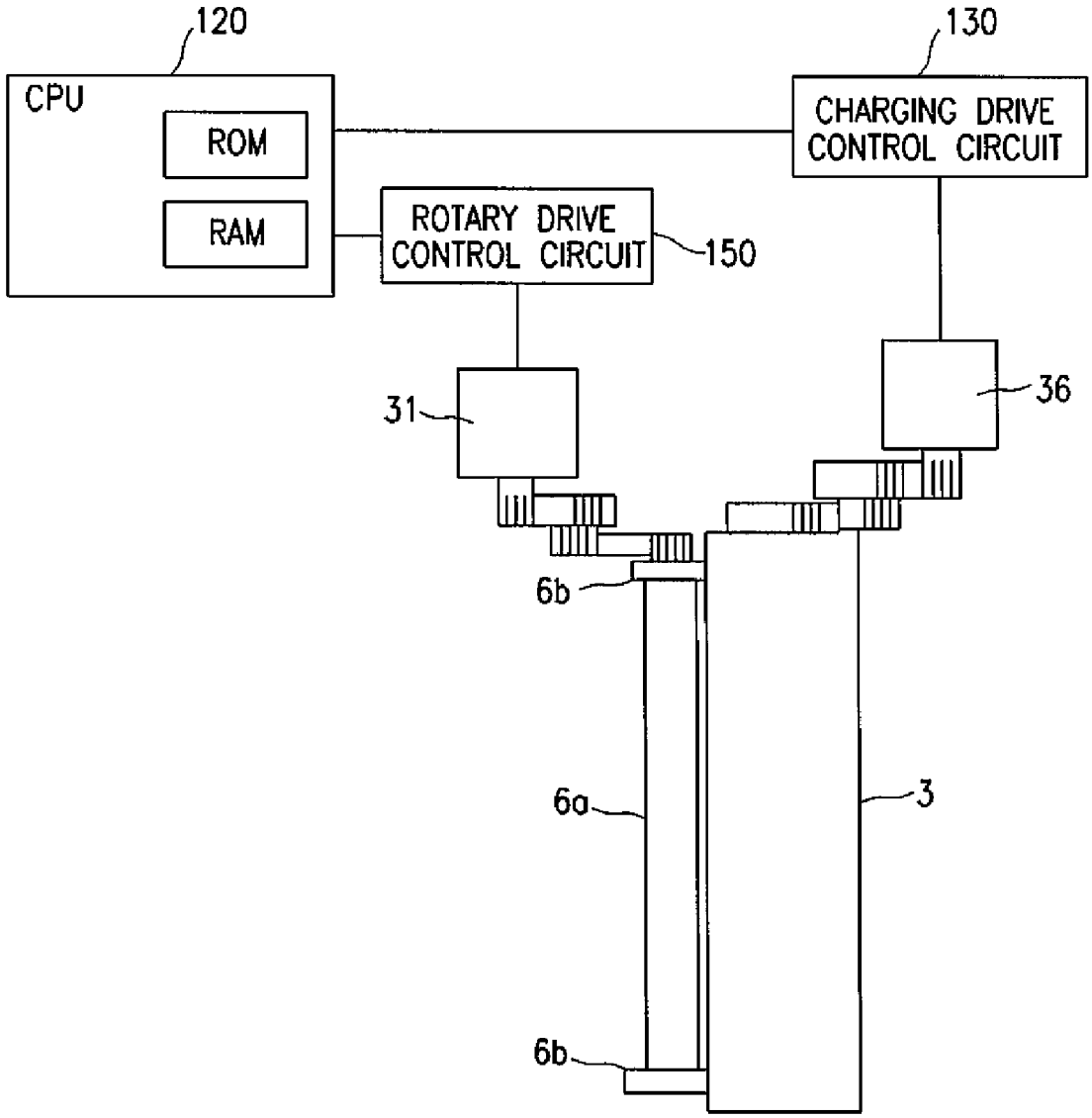
FIG. 8 is an outline constitution view of a drive system of a developing roller and a photosensitive body.

According to a system of driving the photosensitive body 3 and the developing roller 6*a*, as shown by FIG. 8, a photosensitive drive motor 36 and a developing roller drive motor 31 which are respectively driven to rotate are controlled by CPU 120 respectively via the charging drive control circuit 130 and the rotary control drive circuit 150. Further, the developing roller 6*a* is driven to rotate by the developing roller drive motor 31 at a predetermined rotational speed $V_{DR}$ larger than a rotational speed $v_P$ of the photosensitive body 3 by being butted to the photosensitive body 3 by rolling members 6*b* into which a rotating shaft thereof is rotatably inserted inwardly and which is arranged at both ends thereof coaxially therewith. The rolling member 6*b* is rotated at a peripheral speed the same as that of the photosensitive body 3 since the rotating shaft of the developing roller 6*a* is rotatably inserted thereinto. Therefore, a peripheral speed of the rotating shaft of the developing roller 6*a* becomes faster than a peripheral speed at an inner peripheral face of the rolling member 6*b*, and in being operated to carry out development, there is established a relationship in which an angular velocity of the rotating developing roller 6*a* becomes larger than angular velocities of the rolling member 6*b* and the photosensitive body 3 and the developing roller 6*a* is operated in a direction of increasing the speed relative to the photosensitive body 3 larger than constituting a load.

Figure 7A:
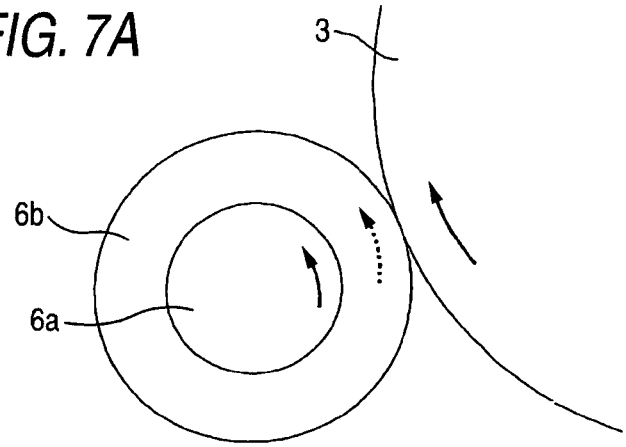
FIGS. 7A-7E illustrate drawings for explaining a relationship between driving to develop a photosensitive body and a non-uniformity in rotating a photosensitive body.

When the developing roller 6*a* is rotated or stopped in a state in which a rolling member 6*b* arranged coaxially with the developing roller 6*a* is butted to the photosensitive body 3 and is driven to rotate by rotating the photosensitive body 3 freely on an axis thereof as shown by FIG. 7A, load is significantly changed for the photosensitive body 3 to cause a non-uniformity in rotation thereof. Particularly, in starting or stopping to rotate the developing roller 6*a*, the load is changed significantly. For example, after an initial stage of driving to rotate, for example, a stepping motor by making a current flow from a state in which the current of the stepping motor is cut and a rotor thereof is free, irregular movement or impact is produced by mechanical play, rattling or the like. Similarly, when the stepping motor is stopped at a certain phase and the current is cut, a constraining force operated since the current has been made to flow heretofore is released to abruptly nullify (free) and therefore, the irregular movement is still produced. In accordance with the movement, the non-uniformity in rotation is brought about by varying the irregular load on the photosensitive body 3 which is being rotated at constant speed. The non-uniformity in rotation of the photosensitive body 3 poses a problem that a nonuiformity in the latent image is brought about when the latent image is formed on the photosensitive body 3, a non-uniformity in the image is brought about when the toner image on the photosensitive body 3 is transferred onto the intermediate transferring belt 12, the nonuniformities appear as nonuniformities or streaks in the image and therefore, the image is deteriorated.

Hence, according to the embodiment, the developing roller 6*a* is driven by the stepping motor and stopped by controlling the phase to constitute a holding state by holding the stepping motor at the same phase in a conductive state. That is, the stepping motor is set in a hold mode. Here, in the holding state and in driving to rotate the stepping motor, a torque in the holding state may be smaller than that in driving the stepping motor to carry out development and therefore, there is constituted the holding state at the same phase in the conductive state by stopping to rotate the stepping motor and making the current lower than a current in driving to rotate the stepping motor. Thereby, power consumption and a heat generating amount can be restrained. The developing roller 6*a* is controlled to smoothly stop and restart by carrying out a slowdown control of the speed when the developing roller 6*a* is stopped from the developing speed and carrying out a slow up control of the speed when the developing roller 6*a* is started to the developing speed from being stopped.

Further, the rotational speed $V_{DR}$ of the developing roller 6*a* is larger than the rotational speed $v_P$ of the photosensitive body 3 as described above and therefore, in the slowdown control of the rotational speed of the developing roller 6*a*, operation is reversed from a state of operating rotation of the developing roller 6*a* in a plus direction in the direction of rotating the photosensitive body 3 to a minus direction, that is, a decelerating direction by constituting a boundary by a point at which a ratio of peripheral speeds thereof becomes 1. Similarly, in the slow up control of the rotational speed of the developing roller 6*a*, operation is reversed from a state in which rotation of the developing roller 6*a* is operated in the minus direction in the direction of rotating the photosensitive body 3 to the plus direction, that is, an accelerating direction by constituting the boundary by the point at which the ratio of peripheral speeds thereof becomes 1. Therefore, when deceleration is carried out at uniform acceleration (negative acceleration, deceleration), the load is reversed to a total reverse direction to bring about rapid variation for the photosensitive body 3 particularly before and after the ratio of peripheral speeds becomes 1. In order to resolve such a drawback, in a region in which the rotational speed of the developing roller 6*a* becomes substantially the same as the rotational speed $v_P$ of the photosensitive body 3, the acceleration (negative/positive acceleration) of deceleration/acceleration is made to be smaller than those of speed regions therebefore and thereafter.

Figure 9:
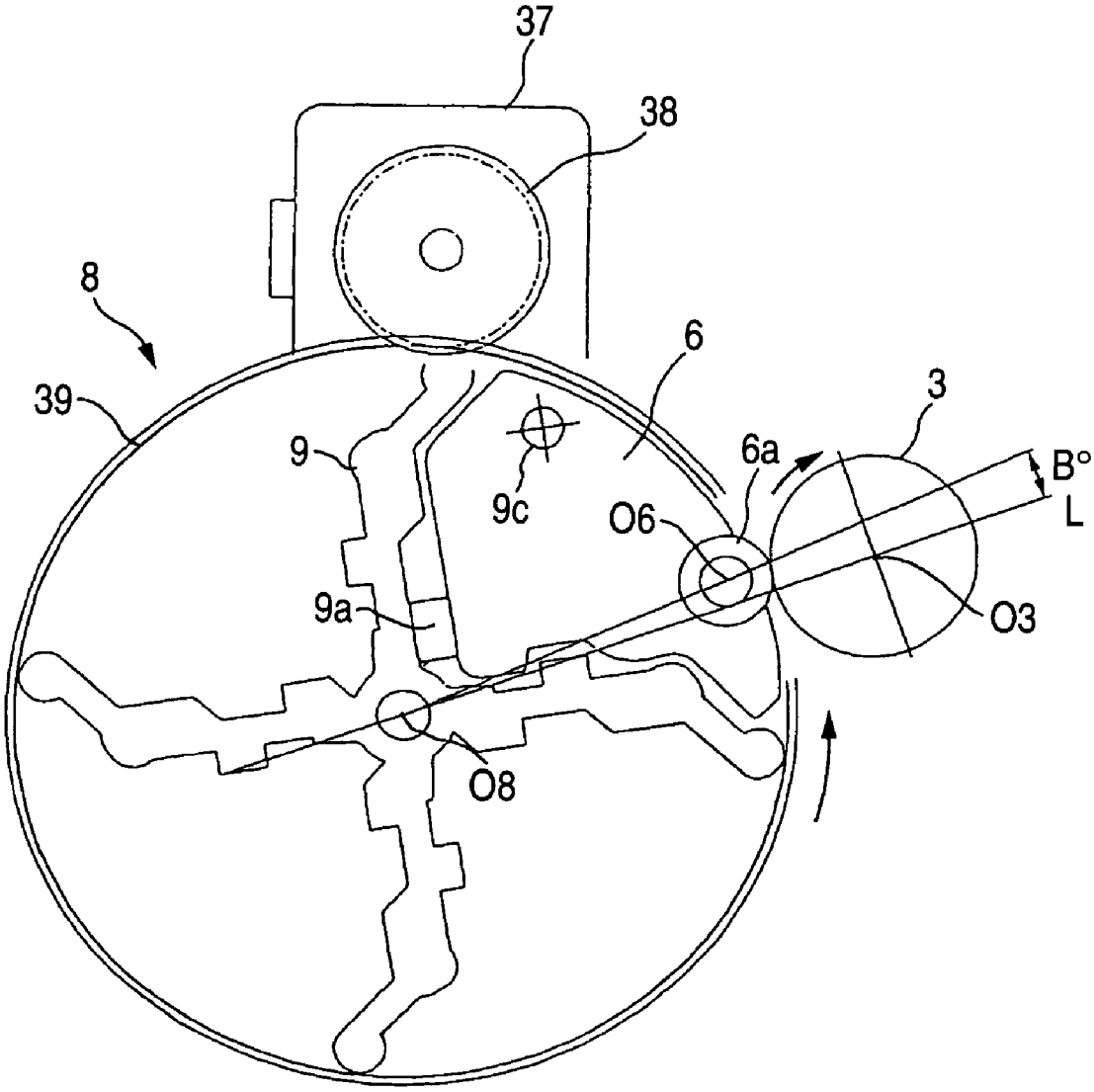
FIG. 9 illustrates views showing a state in which a rotary development apparatus is positioned by being rotated to move by operation of switching a developing color and the developing roller is brought into contact with the photosensitive body.

FIG. 9 is a view showing a state in which the rotary development apparatus is rotated to move by being operated to switch a developing color to position and the developing roller is brought into contact with the photosensitive body, numeral 37 designates a rotary development apparatus drive motor, numeral 38 designates a drive motor gear, numeral 39 designates a rotary development apparatus rotating gear, notation O3 designates a rotational center of the photosensitive body, notation O6 designates a rotational center of the developing roller, and notation O8 designates a rotational center of the rotary development apparatus.

As shown by FIG. 9, the rotary development apparatus 8 includes the rotary development apparatus rotating gear 39 along an outer periphery thereof, the drive motor gear 38 is brought in mesh with the rotary development apparatus rotating gear 39 and the rotary development apparatus 8 is driven to rotate by the rotary development apparatus motor 37 by constituting a rotational direction by the counterclockwise direction as illustrated. The developing device 6 mounted attachably and detachably to an from the rotary development apparatus 8 is positioned to press the developing roller 6*a* to the photosensitive body 3 such that a straight line connecting the rotational center O8 of the rotary development apparatus 8 and the rotational center O6 of the developing roller 6*a* is disposed on a downstream side in a rotational direction from a straight line L connecting the rotational center O8 of the rotary development apparatus 8 and the rotational center O3 of the photosensitive body 3.

The developing device 6 is pivotably mounted by constituting a fulcrum thereof by a developing device pivoting fulcrum 9*c* and pivoting thereof is restricted by a developing device pivoting restricting portion on a side of the developing device 6 and a developing device pivoting restricting portion on a side of the rotary frame 9, and urged in the direction of the photosensitive body 3 by a developing device urging spring 9*a* provided at the rotary frame 9 and is brought into contact with the photosensitive body 3 by a predetermined pressing force.

Further, when operation of switching a developing color is started by the rotary development apparatus drive motor 37 and the rotary development apparatus 8 is rotated to move, at the developing device 6 finished with developing operation, pivoting thereof is restricted by the developing device pivoting restricting portion on the side of the developing device 6 and the developing device pivoting restricting portion on the side of the rotary frame 9 and the pivoting roller 6*a* is separated from the photosensitive body 3. Further, at the developing device 6 for successively carrying out the developing operation, the developing roller 6*a* is brought into contact with the photosensitive body 3 along with rotational movement of the rotary development apparatus 8 and reaches the straight line L connecting the rotational center O3 of the rotary development apparatus 8 and the rotational center O3 of the photosensitive body 3 and is rotated to move and thereafter positioned such that the developing roller 6*a* is brought into contact with the photosensitive body 3 on the downstream side in the rotational direction by a rotational angle B° shown in FIG. 9.

In the case in which the latent image is formed on the photosensitive body 3 by carrying out selective exposure in accordance with image information by the exposing device 5, when the photosensitive body 3 is moved by rattling in view of a structure thereof provided for fitting and mounting described above, or a non-uniformity in rotation is brought about, a non-uniformity in the image and a failure in the image are brought about by a shift in exposure. Further, also in the case in which the toner image formed on the photosensitive body 3 is transferred onto the intermediate transferring belt 12 by the primary transferring roller 13, similarly, when movement or the non-uniformity in rotation is brought about in the photosensitive body 3, the non-uniformity in the image and the failure in the image are brought about by a shift in transcription or the like. The larger the variation in an external force exerted to the photosensitive body 3 and the larger the absolute value, the more liable to bring about the movement and the non-uniformity in rotation of the processing member 3.

A pressing force for pressing the developing roller 6*a* to the photosensitive body 2 is one of the external forces and becomes a maximum value when the developing roller 6*a* is disposed on the straight line L connecting the rotational center O8 of the rotary development apparatus 8 and the rotational center O3 of the photosensitive body 3 and the non-uniformity in rotation is liable to be brought about at the photosensitive body 3. Further, in the case in which the developing roller 6*a* is pressed to the photosensitive body 3 on the straight line L connecting the rotational center O8 of the rotary development apparatus 8 and the rotational center O3 of the photosensitive body 3, actually, when the developing roller 6*a* is pivoted slightly in a left and right direction from above the straight line L in accordance with pivoting the developing device 6, a component of the pressing force is operated in the direction of rotating the photosensitive body 3 or operated in the direction of inversely rotating the photosensitive body 3 relative to the direction of a tangential line of a portion for pressing the developing roller 6*a* and the photosensitive body 3, to thereby also constitute a factor of being liable to produce a non-uniformity in rotation in the photosensitive body 3.

When the developing roller 6*a* is pressed to the photosensitive body 3 on the downstream side in the rotational direction of the straight line L connecting the rotational center O8 of the rotary development apparatus 8 and the rotational center of the O3 of the photosensitive body 3 shown in FIG. 9 at the developing position for carrying out the developing operation as in the embodiment, the pressing force can be made to be smaller than that in the case of pressing the developing roller 6*a* to the photosensitive body 3 on the straight line L connecting the rotational center O8 of the rotary development apparatus 8 and the rotational center O3 of the photosensitive body 3. Further, the component of the pressing force can be operated in a constant direction without being operated in the direction of rotating the photosensitive body 3 or in the direction of inversely rotating the photosensitive body 3. Owing to the facts, the movement and the non-uniformity in rotation of the photosensitive body 3 by pressing the developing roller 6*a* to the photosensitive body 3 can be reduced.

Although even in the case in which the position of pressing the developing roller 6*a* to the photosensitive body 3 is disposed on an upstream side in the rotational direction contrary to the downstream side in the rotational direction shown in FIG. 9, the case is similar to the above-described, in this case, immediately after starting to operate to switch the developing color of the rotary development apparatus 8, during a time period in which the developing roller 6*a* passes the straight line L connecting the rotational center O8 of the rotary development apparatus 8 and the rotational center O3 of the photosensitive body 3, the pressing force is maximally varied. That is, immediately after starting to operate to switch the developing color of the rotary development apparatus 8, the pressing force of pressing the developing roller 6*a* to the photosensitive body 3 is increased and is maximized on the straight line L and thereafter reduced to null. Further, as described above, before and after passing the straight line L maximizing the pressing force, the component of the pressing force is reversed relative to the direction of rotating the photosensitive body 3. That is, the component is switched from a braking component to an accelerating component to be liable to maximally bring about the non-uniformity in rotation at the photosensitive body 3.

Therefore, in the case in which the toner image on the photosensitive body 3 is being transferred onto the intermediate transferred belt 12 by the primary transferring roller 13, when the rotary development apparatus 8 is operated to switch the developing color, the non-uniformity in transcription is further deteriorated by the movement and the non-uniformity in rotation of the photosensitive body 3. In this case, even when the developing operation has been finished, the rotary development apparatus 8 cannot be operated to switch the developing color until finishing transcription. Thereby, the rotary development apparatus 8 cannot swiftly be shifted to be operated to form the image of the successive developing color.

By carrying out development by pressing the developing roller 6*a* to the photosensitive body 3 on the downstream side in the rotational direction from the straight line L connecting the rotational center O8 of the rotary development apparatus 8 and the rotational center O3 of the photosensitive body 3 by the rotational angle B° as shown by FIG. 9 of the embodiment, when the rear end of the latent image formed on the photosensitive body 3 is developed by the developing device 6, the rotary development apparatus 8 can immediately be started to switch the developing color for moving the developing device 6 to the developing position. Thereby, there is not brought about the movement and the non-uniformity in rotation of the photosensitive body 3 as in the case of carrying out development by pressing the developing roller 6*a* to the photosensitive body 3 on the upstream side in the rotational direction immediately after starting to operate to switch the developing color and the shift in transcription in primary transcription can be eliminated.

In recent years, high speed formation of the printing speed is requested for the image forming apparatus and therefore, in the image forming apparatus adopting the rotary development apparatus 8 it is requested to shorten a time period required for operation of switching the developing color of the rotary development apparatus 8 interchanging the respective developing device 6 and increase the rotational speed and it is also requested to shorten an interval (sheet interval) between the images on the intermediate transferring medium 12. According to the embodiment, when the rear end of the latent image formed on the photosensitive body 3 is developed by the developing device 6, even in the case in which the toner image after development is being transferred onto the intermediate transferring belt 12 at the primary transferring roller 13, the developing roller 6*a* is immediately stopped and the rotary development apparatus 8 can be started to operate to switch the developing color for successively moving the developing device 6 of the successive color swiftly to the developing position.

Further, in the case in which development is carried out by pressing the developing roller 6*a* to the photosensitive body 3 on the downstream side in the rotational direction from the straight line L connecting the rotational center O8 of the rotary development apparatus 8 and the rotational center O3 of the photosensitive body 3 by the rotational angle B°, at an instance of finishing the operation of switching the developing color of the rotary development apparatus 8, the rotary development apparatus 8 passes the straight line L maximizing the pressing force and therefore, at this occasion, the maximum movement and the maximum non-uniformity in rotation are brought about in the photosensitive body 3. However, up to the time point, the rear end of the toner image has been transferred onto the intermediate transferring medium 12 by the primary transferring apparatus 13 and the primary transcription has been finished and therefore, adverse influence can be prevented from being effected on transcription. Meanwhile, starting of the selective exposure in accordance with image information by the exposing device 5 for forming the latent image on the photosensitive body 3 is not effected with adverse influence by movement and non-uniformity in rotation of the photosensitive body 3 brought about when passing the straight line L maximizing the pressing force at the instance of finishing to operate to switch the developing color and therefore, it is preferable to start the selective exposure after finishing the operation of switching the developing color of the rotary development apparatus 8.

To carry out development by pressing the developing roller 6*a* to the photosensitive body 3 on the downstream side in the rotational direction from the straight line L connecting the rotational center O8 of the rotary development apparatus 8 and the rotational center O3 of the photosensitive body 3 by the rotational angle B° as shown by FIG. 9 of the embodiment, is to press the developing roller 6*a* to the photosensitive body 8 on the downstream side in the rotational direction from the direction of the rotational center O3 of the photosensitive body 3 relative to the photosensitive body 3 in other point of view. Thereby, the variation in the pressing force immediately after the operation of switching the developing color of the rotary development apparatus 8 can be reduced or alleviated by reducing or alleviating the above-described pressing force. For that purpose, the position of the developing device pivoting fulcrum 9*c* is set relative to the position of pressing the developing roller 6*a* to the photosensitive body 3 such that the developing roller 6*a* is pressed to the photosensitive body 3 on the downstream side in the rotational direction of the photosensitive body 3 relative to the straight line connecting the rotational center O6 of the developing roller 6*a* and the rotational center O3 of the photosensitive body 3 by the predetermined angle from the rotational center O6 of the pressing roller 6*a* to the rotational center O3 of the photosensitive body 3.

Figure 7B:
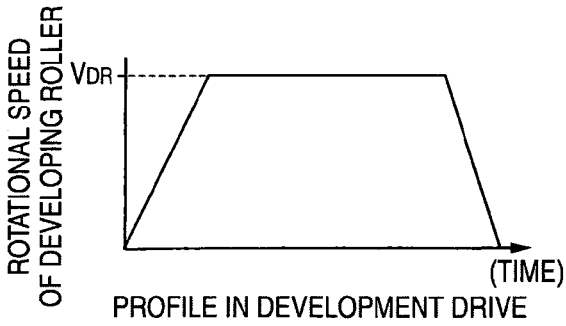
Figure 7D:
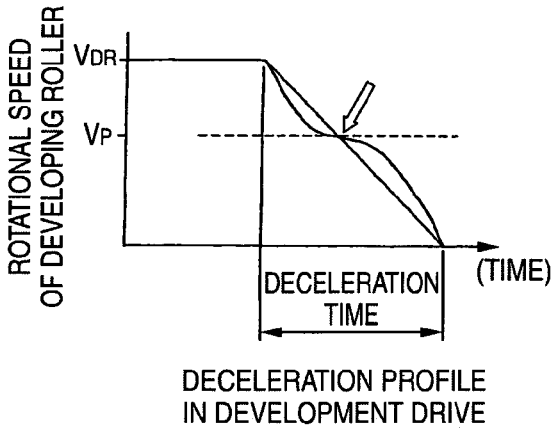
Figure 7C:
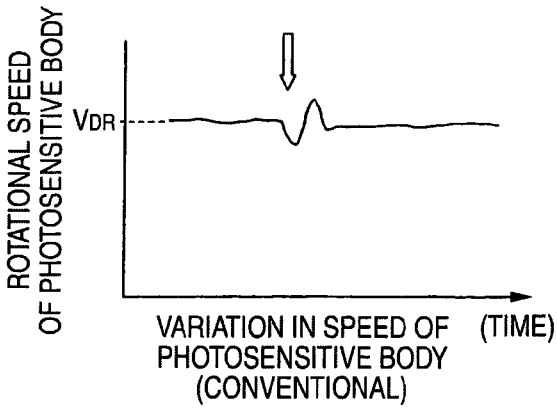
Figure 7E:
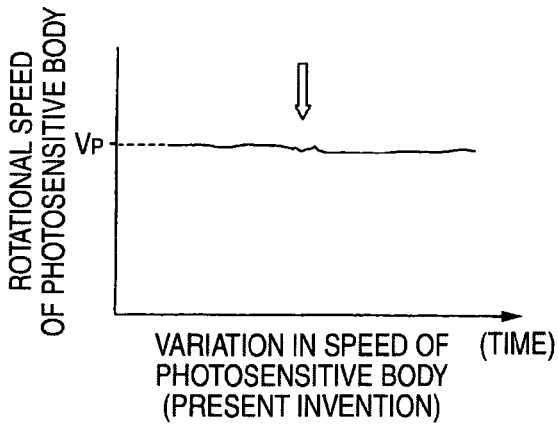

For example, when the acceleration is substantially nullified temporarily at the region in which the peripheral speed of the photosensitive body 3 and the peripheral speed of the developing roller 6*a* (substantially peripheral speed of the rolling member 6*b*) become the same as each other, the smoothest variation can be realized when the load is reversed to the totally reverse direction. When the acceleration (negative acceleration, deceleration) is made to be constant in accelerating the developing roller 6*a* as shown by FIG. 7B, a variation in the speed of the photosensitive body significantly appears as shown by FIG. 7C, however, in comparison therewith, when the acceleration is reduced to be proximate to null when the rotational speed of the developing roller 6*a* is near to the rotational speed substantially the same as that ($v_P$) of the photosensitive body 3 as shown by FIG. 7D, it is found that the variation in the speed of the photosensitive body can be restrained as shown by FIG. 7E.

A program for executing the above-described processing is stored in, for example, ROM 124 in FIG. 4 and the program is executed by CPU 120. According to the image forming apparatus of the embodiment, an accumulated time period of rotating the developing roller 6*a* in forming the color image and an accumulated time period of rotating the developing roller 6*a* in forming the single color continuous image become substantially the same as each other. Describing in details, a time period of rotating the developing roller 6*a* is a time period of developing the latent images in correspondence with the respective colors in forming the color image and is a time period of developing the latent images in correspondence with the respective record media in forming the single color continuous image and the developing roller 6*a* is stopped when development is not carried out in forming any of the image. That is, even in the case of continuously developing the image by using the developing device of a specific color, when the latent image is not present on the photosensitive body 3, the developing roller 6*a* is stopped and therefore, the developing roller 6*a* can be prevented from being rotated uselessly.

Thereby, the toner can be prevented from being consumed and the toner can be prevented from being scattered to contaminate inside of the apparatus by carrying the useless toner by the developing roller 6*a* in the region in which the latent image is not formed and the development is not carried out. Further, by reducing a holding current in stopping the developing roller 6*a*, useless consumption of power and heat generation can be restrained, and by making changes of rotation between stopping and rotating the developing roller 6*a* to carry out development smooth, a non-uniformity in rotating the photosensitive body 3 can be restrained and a shift in forming the latent image and in transferring the toner image can be prevented from being brought about and therefore, a deterioration of the image by bringing about non-uniformity or streak of the image can be prevented.

Further, wear of, for example, a toner supplying roller, the layer thickness restricted member, a seal member or the like brought into contact with the developing roller 6*a* can be reduced. Further, by reducing wear of the toner pressed to the side of the developing roller 6*a* by the members and sliding each other to produce friction to charge useless deterioration of the toner can be prevented. The reduction in the wear of the toner supplying roller, the layer thickness restricting member and the seal member as well as prevention of deterioration of the toner are effective not only in maintaining the image quality of the formed image but also in recycling the developing device to be recycled.

That is, when a difference between amounts of wearing the members of the toner supplying rollers, the film thickness restricted members, the seal member and the like used in the developing device 6K of black K which is frequently used in forming the single color image and the other pressing apparatus 6Y, 6M, 6C is small, by making shapes and materials of the members which are liable to wear the same as each other, the developing device black K and the other developing devices 6Y, 6M, 6C can be recovered without classifying these, further, the developing device can be recycled by the same step. Thereby, recovery and the recycle operation for recycling is facilitated and the developing device can efficiently be recycled. Further, in recycling, by reading data indicating a numbers of times of recycling of the developing device side memories provided at the respective developing device 6Y, 6M, 6C, 6K, it can easily be determined whether a predetermined member of the recovered developing device is to be interchanged and the efficiency of recycling operation can further be promoted.

Further, the invention is not limited to the above-described embodiment but can variously be modified. Although in the above-described embodiment, in continuously forming the single color image for the plurality of record media, the region in which the latent image is not formed is constituted by the region between the image forming range of an amount of a medium and the latent image forming range of an amount of a medium to be developed successively and a timing of stopping the developing roller is constituted by a timing at which the front end of the region in which the latent image is not formed in the direction of rotating the photosensitive body reaches the developing roller 6*a*, the region in which the latent image is not formed may be constituted by a region in which the latent image is not formed over an entire width in an axial direction of the photosensitive body. In this case, regardless of the latent image forming range and the size of the medium, at a position at which the latent image is not present, the developing roller is stopped and therefore, useless consumption or wear or deterioration of the toner supplying member, the layer thickness restricting member, the seal member and the toner can maximally be prevented. Further, when the timing of stopping the developing roller is constituted by a timing after the front end of the region in which the latent image is not formed in the direction of rotating the photosensitive body reaches the developing roller to be maximally proximate thereto and the predetermined time period elapses, development in the latent image region can be ensured and deficiency of the image and a reduction in the darkness can be prevented at the rear end of the image.

Although the rotary development apparatus 8 of the embodiment is constituted by the image forming apparatus of full color of 4 colors mounted attachably and detachably with the four developing devices 6Y, 6M, 6C, 6K as described above, there may be constituted a monochromatic image forming apparatus in which only the developing device of the toner in black K is mounted, the developing device black K is at standby at the stand by position (home position) and in forming the image, the developing device 6K of black K develops the electrostatic latent image on the photosensitive body 3 into the toner image at the developing position by being moved to rotate from the standby position. Thereby, the rotary development apparatus 8 having the same design specification can be used for full color and monochromatic color and by commonly using full color and monochromatic color, in comparison with the case of designing an image forming apparatus exclusive for full color or exclusive for monochromatic color, cost of maintenance control, design, fabrication can considerably be reduced.

Further, although an explanation has been given such that the developing roller is stopped between sheets in forming a single color continuous image, also in forming the image of full color, a similar control may be carried out to between sheets of the continuous toner images in forming the image of a small image for forming the toner images continuously for every two sheets.

What is claimed is:

1. An image forming apparatus comprising:

an image carrier adapted such that a latent image is formed thereon;

a developing device having a developing roller operable to carry a developer for developing the latent image at a developing position opposing the image carrier, as a developed image which is to be transferred, to a medium at a transferring position;

a rotary development apparatus supporting the developing device centering on a rotating shaft thereof to rotate to move to the developing position;

a stepping motor operable to drive the developing roller; and a controller operable to bring the stepping motor in a rotating state when the developing roller opposes a region that the latent image is formed on the image carrier and to hold the stepping motor in the same phase while inputting a current when the developing roller opposes a region that the latent image is not formed on the image carrier.

2. The image forming apparatus according to claim 1, wherein the current is lower than a current for rotating the stepping motor so that the stepping motor is held in the same phase.

3. The image forming apparatus according to claim 1, wherein the controller is operable to perform a slowdown control when a rotation of the stepping motor is stopped.

4. The image forming apparatus according to claim 3, wherein the controller is operable to start the slowdown control after a front end of the region in which the latent image is not formed reaches the developing position.

5. The image forming apparatus according to claim 3, wherein the controller is operable to start the slowdown control after a front end of the region in which the latent image is not formed reaches the transferring position.

6. The image forming apparatus according to claim 3, wherein the controller is operable to start the slowdown control after a rear end of the latent image region reaches the developing position.

7. The image forming apparatus according to claim 1, wherein a rotational deceleration of the developing roller in a vicinity of a rotational speed corresponding to a rotation of the image carrier is set smaller than a rotational deceleration in another range of the rotational speed of the developing roller when a rotation of the developing roller is stopped.

8. The image forming apparatus according to claim 1, wherein the controller is operable to perform a slow up control from a rear end of the region in which the latent image is not formed, when the developing roller is driven to rotate.

9. The image forming apparatus according to claim 8, wherein the controller is operable to start the slow up control before the rear end of the region in which the latent image is not formed reaches the developing position.

10. The image forming apparatus according to claim 1, wherein the region in which the latent image is not formed is disposed between adjacent latent images when a plurality of the latent images are continuously formed on the image carrier.

11. The image forming apparatus according to claim 1, further comprising a rolling member arranged coaxially with the developing roller and adapted to come in contact with the image carrier when the developing device is disposed at the developing position.

12. An image forming apparatus comprising:

an image carrier adapted such that a latent image is formed;

a developing device having a developing roller operable to carry a developer for developing the latent image at a developing position opposing the image carrier, as a developed image which is to be transferred to a medium at a transferring position;

a rolling member coaxially arranged with the developing roller and adapted to come in contact with the image carrier when the developing roller is placed in the developing position;

a motor operable to drive the developing roller; and a controller operable to rotate the developing roller such that an acceleration in at least either of decelerating or accelerating the developing roller is made smaller rotational when the rotational speed of the developing roller becomes greater or smaller than the speed of the image carrier.

13. The image forming apparatus according to claim 12, wherein the controller is operable to decelerate the developing roller after a rear end of the latent image formed at the image carrier reaches the developing position and to accelerate before a front end of the latent image formed at the image carrier reaches the developing position.

14. The image forming apparatus according to claim 12, wherein the controller is operable to nullify the acceleration or deceleration of the developing roller when the rotational speed of the developing roller becomes greater or smaller than the rotational speed of the image carrier, respectively.

15. The image forming apparatus according to claim 12, wherein the developing device comprises a developing rotary unit mounted with a developing cartridge at a rotary frame and rotated to move to carry out an operation of switching development.

16. The image forming apparatus according to claim 15, wherein the developing rotary unit is mounted with a plurality of the developing cartridges respectively containing different colors of toner.

17. The image forming apparatus according to claim 16, wherein the controller is operable to control the motor to cause the developing roller to decelerate prior to starting the operation of switching development carried out when a multi-color image is formed and to accelerate after finishing the operation of switching development.

18. The image forming apparatus according to claim 15, wherein the developing rotary unit is rotated to move in a rotational direction reverse to a direction of rotating the image carrier and the developing roller is butted to the image carrier by the rolling member at a position on a downstream side in the direction of rotating the image carrier from a line connecting a rotational axis of the developing rotary unit and a rotational axis of the image carrier.

19. The image forming apparatus according to claim 12, wherein the developing roller is held in a state of being stopped at a region in which the image is not formed between the images when a plurality of sheets of the images are continuously formed.

20. The image forming apparatus according to claim 19, wherein:

the motor is a stepping motor; and the stepping motor maintains the state of being stopped by being held at the same phase by a current lower than a current in being driven to rotate.

* * * * *